US007743570B2

(12) United States Patent
Reichert

(10) Patent No.: US 7,743,570 B2
(45) Date of Patent: Jun. 29, 2010

(54) METHOD OF FABRICATING MUNTIN BARS FOR SIMULATED DIVIDED LITE WINDOWS

(75) Inventor: Gerhard Reichert, New Philadelphia, OH (US)

(73) Assignee: Edgetech I.G., Inc., Cambridge, OH (US)

( * ) Notice: Subject to any disclaimer, the term of this patent is extended or adjusted under 35 U.S.C. 154(b) by 0 days.

(21) Appl. No.: 09/775,074

(22) Filed: Feb. 1, 2001

(65) Prior Publication Data

US 2001/0034990 A1 Nov. 1, 2001

Related U.S. Application Data

(63) Continuation-in-part of application No. 09/637,722, filed on Aug. 11, 2000, now Pat. No. 6,425,221.

(60) Provisional application No. 60/148,842, filed on Aug. 13, 1999.

(51) Int. Cl.
*E06B 9/01* (2006.01)

(52) U.S. Cl. ..... 52/456; 52/455; 52/786.13; 52/799.11; 428/34

(58) Field of Classification Search ..... 52/456, 52/455, 314, 398, 399, 790, 304, 311.1, 316, 52/786.13, 630, 312, 799.12, 666, 664, 204.61, 52/790.1, 786.11; 428/71, 34
See application file for complete search history.

(56) References Cited

U.S. PATENT DOCUMENTS 3,212,179 A * 10/1965 Koblensky ..... 52/455
3,226,903 A * 1/1966 Lillethun ..... 52/172
3,280,523 A * 10/1966 Stroud et al. ..... 52/172
3,308,593 A * 3/1967 Smith ..... 52/314
3,381,431 A * 5/1968 Jacobson ..... 52/309.1
3,474,587 A * 10/1969 Martin ..... 52/456
3,678,651 A * 7/1972 Hicks ..... 52/311
3,762,118 A * 10/1973 Sanders ..... 52/171
3,805,470 A * 4/1974 Brown ..... 52/204.597
4,015,390 A * 4/1977 Howorth ..... 52/772
4,113,905 A * 9/1978 Kessler ..... 428/34
4,381,908 A * 5/1983 Roth ..... 425/129.1
4,437,284 A * 3/1984 Cribben et al. ..... 52/456
4,564,540 A * 1/1986 Davies et al. ..... 428/34
4,567,710 A * 2/1986 Reed ..... 52/786.13
4,610,901 A * 9/1986 Linscott ..... 428/38
4,649,681 A * 3/1987 Eisele ..... 52/202
4,672,784 A * 6/1987 Pohlar ..... 52/235

(Continued)

FOREIGN PATENT DOCUMENTS

DE 4101 277 A1 7/1992

(Continued)

*Primary Examiner*—Phi Dieu Tran A
(74) *Attorney, Agent, or Firm*—Zollinger & Burleson Ltd.

(57) ABSTRACT

A method for fabricating muntin grid pieces includes steps that attach an outer muntin grid element to an inner muntin grid element to form a two piece muntin grid piece. The outer muntin grid element surrounds at least three sides of the inner muntin grid element and may be held to the outer muntin grid element without connectors such as adhesive. The outer muntin grid element may be a slit tube that is spread open to be positioned over the inner muntin grid element.

22 Claims, 24 Drawing Sheets

U.S. PATENT DOCUMENTS

| | | | | | |
|---|---|---|---|---|---|
| 4,710,411 | A | * | 12/1987 | Gerace et al. | 428/34 |
| 4,730,429 | A | * | 3/1988 | Roberts | 52/309.13 |
| 4,756,131 | A | * | 7/1988 | Stoakes | 52/171 |
| 4,783,938 | A | * | 11/1988 | Palmer | 52/171 |
| 4,845,911 | A | * | 7/1989 | Winston et al. | 52/456 |
| 4,850,175 | A | * | 7/1989 | Berdan | 52/790 |
| 4,982,530 | A | * | 1/1991 | Palmer | 49/504 |
| 5,040,347 | A | * | 8/1991 | Valvis | 52/204.591 |
| 5,052,164 | A | * | 10/1991 | Sandow | 52/786.13 |
| 5,077,950 | A | * | 1/1992 | Bretches et al. | 52/456 |
| 5,120,584 | A | * | 6/1992 | Ohlenforst et al. | 428/34 |
| 5,267,421 | A | * | 12/1993 | Salisbury | 52/314 |
| 5,302,425 | A | * | 4/1994 | Taylor | 428/34 |
| 5,345,743 | A | * | 9/1994 | Baier | 52/455 |
| 5,351,459 | A | * | 10/1994 | Kassl et al. | 52/656.5 |
| 5,447,761 | A | * | 9/1995 | Lafond | 428/34 |
| 5,851,609 | A | * | 12/1998 | Baratuci et al. | 428/34 |
| 6,177,156 | B1 | * | 1/2001 | Glover et al. | 428/34 |
| 6,192,651 | B1 | * | 2/2001 | Donaldson | 52/742.13 |
| 6,240,685 | B1 | * | 6/2001 | Eichhorn | 52/204.61 |
| 6,351,923 | B1 | * | 3/2002 | Peterson | 52/786.13 |
| 6,470,643 | B1 | * | 10/2002 | Cantley | 52/660 |
| 2001/0031351 | A1 | * | 10/2001 | Rood | 428/318.6 |

FOREIGN PATENT DOCUMENTS

| | | | | |
|---|---|---|---|---|
| GB | 2054716 | * | 2/1981 | 52/456 |
| GB | 2132675 | * | 7/1984 | 52/204.61 |
| JP | 1-198984 | * | 8/1989 | 52/204.61 |

* cited by examiner

FIG-8
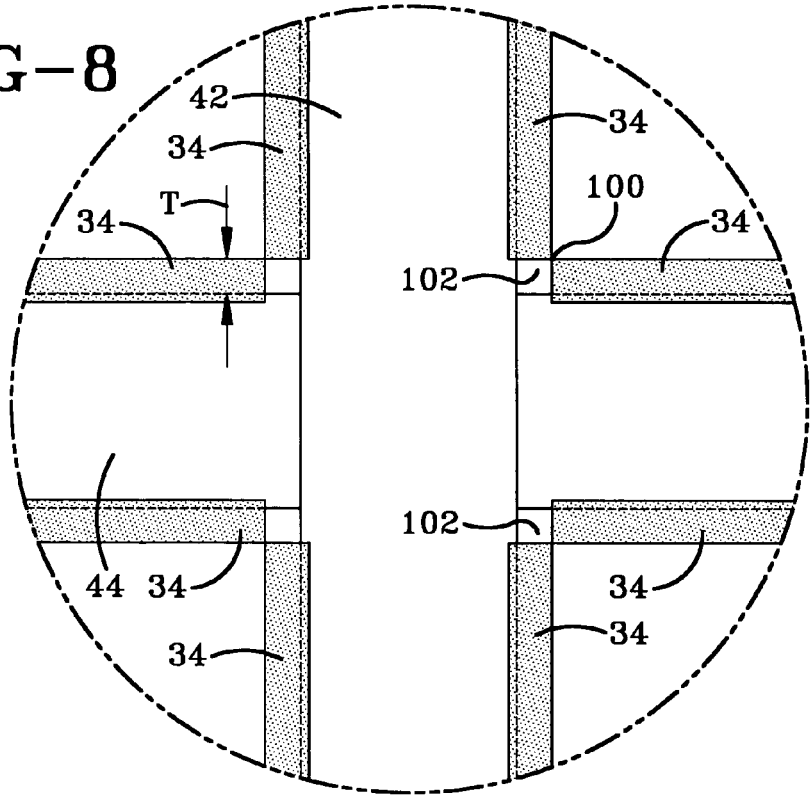
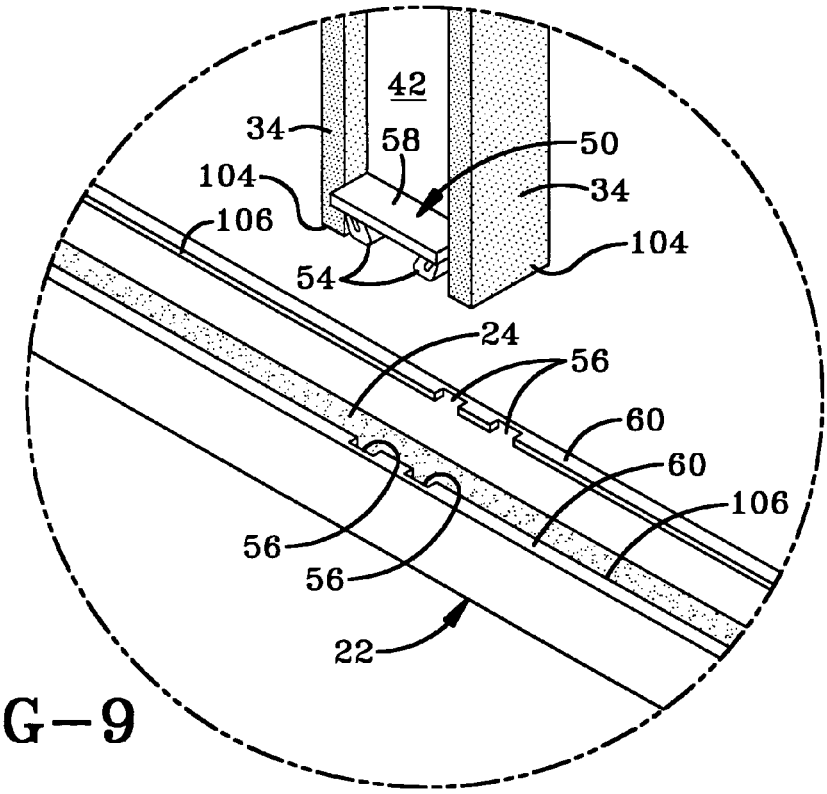
FIG-9

58
22
34
100
44
42
34
58
42
34
34
100
34
34
44
34
58
20
18
24
104
58
30
104
SEE FIG-11

400
402
404
402
404

METHOD OF FABRICATING MUNTIN BARS FOR SIMULATED DIVIDED LITE WINDOWS

CROSS REFERENCE TO RELATED APPLICATIONS

This application is a continuation-in-part application claiming priority from U.S. application Ser. No. 09/637,722, filed Aug. 11, 2000 now U.S. Pat. No. 6,425,221 which claimed priority from U.S. Provisional Application Ser. No. 60/148,842, filed Aug. 13, 1999; the disclosures of both applications are incorporated herein by reference.

BACKGROUND OF THE INVENTION

1. Technical Field

This invention generally relates to windows having muntin bars that simulate the appearance of traditional divided lite windows having individual panes of glass set in wooden muntin bars. More particularly, the present invention relates to a method of fabricating muntin bars on automated machinery for use in simulated divided lite windows. Specifically, the present invention relates to a method of automatically sizing, cutting, and joining foam strips to the top and bottom edges of traditional thin metal inner muntin grid elements for use in insulating windows having outer muntin bars positioned in coincidental alignment with the inner muntin bars. The invention also relates to the structure of the muntin bars.

2. Background Information

Traditional windows have individual panes of glass separated by wooden muntins. While these windows are attractive and have functioned for many years, they are relatively expensive to fabricate. The expense is particularly high when a consumer desires an insulating window having spaced panes of glass sealed together by a perimeter spacer. A single window having twelve panes of glass requires twelve spacers, twenty-four panes of glass, and a precisely formed muntin grid. In addition to the cost of materials, the assembly process is also relatively expensive. Thus, although consumers desire the aesthetic properties of traditional divided lite windows, most are unwilling to pay for a true divided lite window.

Modern, energy efficient insulating windows include at least two panes of glass separated by a spacer to form a sealed cavity that provides insulating properties. These insulating windows are most efficiently manufactured with two large panes of glass separated by a single spacer disposed at the perimeter of the panes. Various solutions have been implemented to provide the divided lite appearance in insulating windows. One solution to the problem has been to place a muntin bar grid between the panes of glass. Another solution has been to place the muntin bar grid on the outer surface of one, or both, panes of glass. Although these solutions provide options for consumers, each has visual drawbacks when compared with traditional muntin bars.

Placing muntin bar grids between the panes of glass is one of the most common solutions to the divided lite problem. In fact, so many internal muntin grids are fabricated that automated muntin bar manufacturing equipment has been created and is used in the art. This equipment works in cooperation with the automated window manufacturing equipment. In this equipment, the user inputs the desired size of window and the computer automatically selects the ideal number of grid intersections to form an aesthetically pleasing muntin bar grid. In other embodiments, the user may override the automatic selection and manually select the number of muntin bar intersections in the grid. The computer then controls automated fabricating equipment that roll forms flat metal stock into the hollow, substantially rectangular muntin bars used to form the muntin bar grid. The muntin bars are dadoed or notched at their intersections half-way through their thickness to provide the overlapping joint required to form the grid. These notched areas are also automatically formed. The muntin bars are then cut to length and an assembler manually assembles the bars into a grid that is mounted to the spacer that spaces the inner and outer panes of glass. The muntin bar grid is attached to the spacer with specially designed clips that fit into holes punched into the spacer during the manufacture of the spacer. These systems allow muntin bar grids to be quickly and easily manufactured for a relatively low price after the user invests in the automated equipment. The muntin bar grids are painted and deburred to have a pleasing appearance either before or after the grid is assembled.

One product developed by Edgetech I. G. of Cambridge, Ohio, in response to the insulating window muntin bar problem includes the use of a pair of material strips positioned on the upper and lower edges of metal muntin bars inside an insulating window assembly. Outer muntin bars are then provided in coincidental alignment with the inner muntin bars to achieve a simulated divided lite appearance. The material strips visually join the aligned outer muntin bars to create the appearance that the muntin bar grid extends entirely through the insulated window assembly. This product also hides the metal muntin bars. The metal muntin bars thus do not have to be painted and may be fabricated from a lower quality material than exposed, painted inner metal muntin bars. Although this product achieved acceptance by the consumer because of its visual appearance, the insulating window manufacturers objected to the relatively large amount of labor required to size, cut, and install the material strips. It is thus desired in the art to provide a method for sizing, cutting, and installing the material strips to muntin bars that are fabricated with automated machinery.

Another problem encountered with this product occurs when the material strips are stretched during installation or applied to the outside of a curved muntin. It has been found that the strips relax overtime and delaminate causing the window to have an unattractive appearance. It is desired in the art to provide a solution to this delamination problem.

SUMMARY OF THE INVENTION

The invention provides a muntin bar system that includes an inner muntin grid element and an outer muntin grid element that is wrapped around at least three sides of the inner muntin grid element. The muntin grid element is positioned between spaced glass sheets in an insulating window unit to simulate a traditional muntin bar.

The invention also provides a muntin grid piece wherein the outer muntin grid element wraps substantially around the inner muntin grid element so that the outer muntin grid element is held to the inner muntin grid element without the use of a connector such as an adhesive. In one embodiment, the outer muntin grid element is in the form of a tube that slides over the inner muntin grid element. In another embodiment, the outer muntin grid element is the form of a slit tube that is spread open and wrapped around the inner muntin grid element.

BRIEF DESCRIPTION OF THE DRAWINGS

FIG. 8 is a front elevational view of one of the intersections of the muntin bar grid of FIG. 7.

FIG. 9 is a perspective view of one end of one of the muntin bars showing the flaps extending over a portion of the muntin bar clips.

Similar numbers refer to similar parts throughout the specification.

DESCRIPTION OF THE PREFERRED EMBODIMENTS

Figure 1:
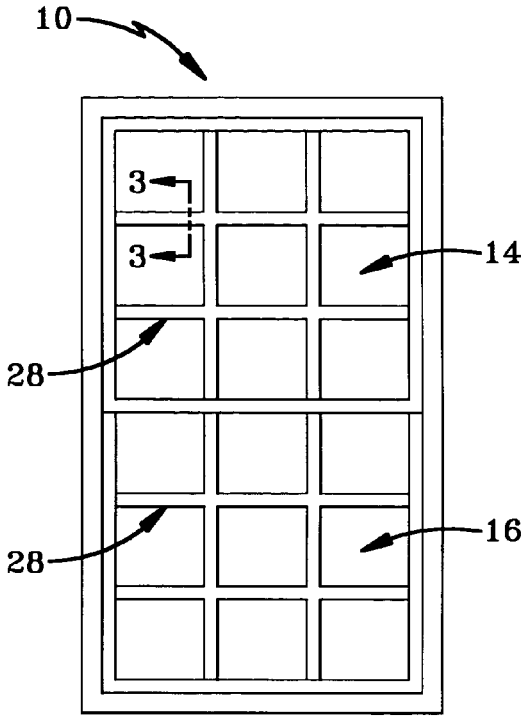
FIG. 1 is a front elevational view of a simulated divided lite window having an upper and lower muntin bar grid formed with two vertical and two horizontal muntin bars.
Figure 2:
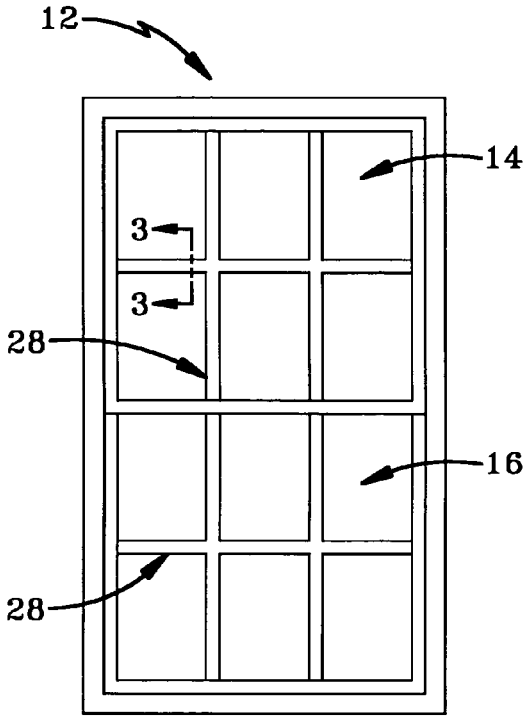
FIG. 2 is a view similar to FIG. 1 showing a window having an upper and lower muntin bar grid with each muntin bar grid being formed with two vertical and one horizontal muntin bar.

Windows having muntin bar grids fabricated according to the concepts of the present invention are indicated generally by the numerals 10 and 12 in FIGS. 1 and 2, respectively. Window 10 is an insulating window having an upper sash 14 and a lower sash 16. Each sash 14 and 16 includes a pair of glass sheets 18 and 20 that are spaced apart by a perimeter spacer 22 having a desiccant matrix 24 (see FIG. 10). Other perimeter spacers 22A and 228 (FIGS. 11A and 11B) may also be used without departing from the concepts of the present invention. As discussed above in the Background of the Invention section of this Application, this type of insulating window is desired by consumers because of its energy saving properties. As also discussed above, consumers desire the appearance of traditional windows fabricated from multiple glass panes mounted in a wooden muntin bar grid. If window 10 were manufactured in the traditional method, eighteen panes of glass would be required in addition to two intricately formed wooden muntin bar grids. Window 12 would also require the two intricately formed muntin bar grids but would only require twelve panes of glass. If window 10 were fabricated with insulating units mounted in traditional muntin bar grids, thirty-six panes of glass and eighteen spacers would be required. Similarly, window 12 would require twenty-four panes of glass with twelve spacers. It may thus be understood why it is desired to utilize muntin bar grids that simulate the appearance of traditional muntins while allowing each window 10 and 12 to be fabricated using only four panes of glass and two spacers.

Figure 3:
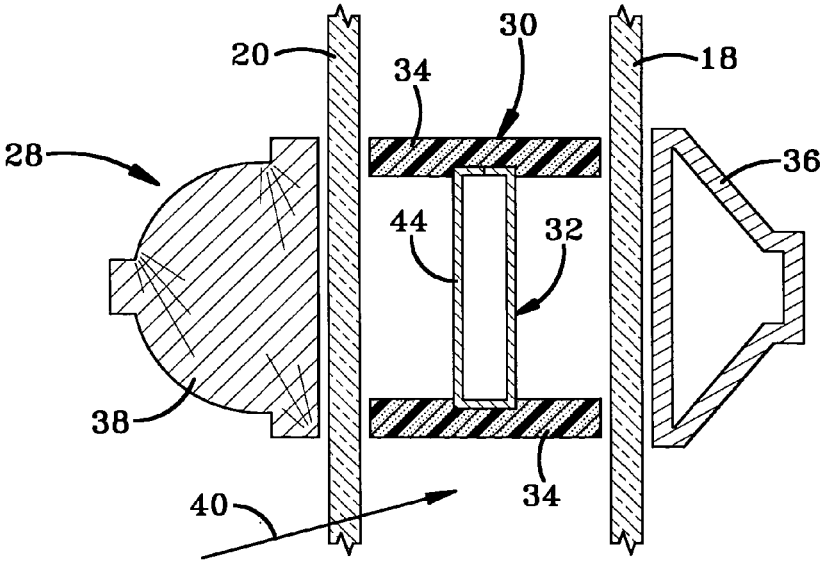
FIG. 3 is a sectional view taken along line 3-3 of FIG. 1 or FIG. 2.

The muntin bar arrangement 28 made in accordance with the concepts of the present invention is used in windows 10 and 12 and depicted sectionally in FIG. 3. Muntin bar arrangement 28 includes a muntin bar grid 30 having an inner muntin grid 32 in combination with a plurality of material strips 34 that serve to visualize join an outer muntin bar 36 with an inner muntin bar 38. By "visually join," it is meant that a person viewing window 10 or 12 along a line, such as that indicated by the numeral 40 in FIG. 3, essentially sees a continuous surface between inner muntin bar 38 and outer muntin bar 36 even though muntin bars 36 and 38 are separated by glass sheets 18 and 20 and material strip 34. Although foam material strips capable of being used to form this muntin bar grid configuration were sold by Edgetech, I. G., of Cambridge, Ohio, in 1994, and are prior art to the present application, the prior method of creating the muntin bar grid was manual, relatively time consuming, and thus relatively expensive. The method of the present invention allows material strips 34 to be efficiently created and efficiently applied to inner muntin grid 32.

In one embodiment of the method of the present invention, the window designer merely needs to input the height and width of a sash along with the number of muntin bar divisions desired for the window. For instance, each sash 14 and 16 of window 10 has a height, a width, and nine divisions. Each sash 14 and 16 of window 12 has a height, a width, and six divisions. The method of the present invention uses this information to automatically form the vertical 42 and horizontal 44 muntin grid elements of inner muntin grid 32 and material strips 34. The method of the present invention also provides that material strips 34 are automatically connected to muntin grid elements 42 and 44 so that grid 30 may be readily assembled.

Figure 4:
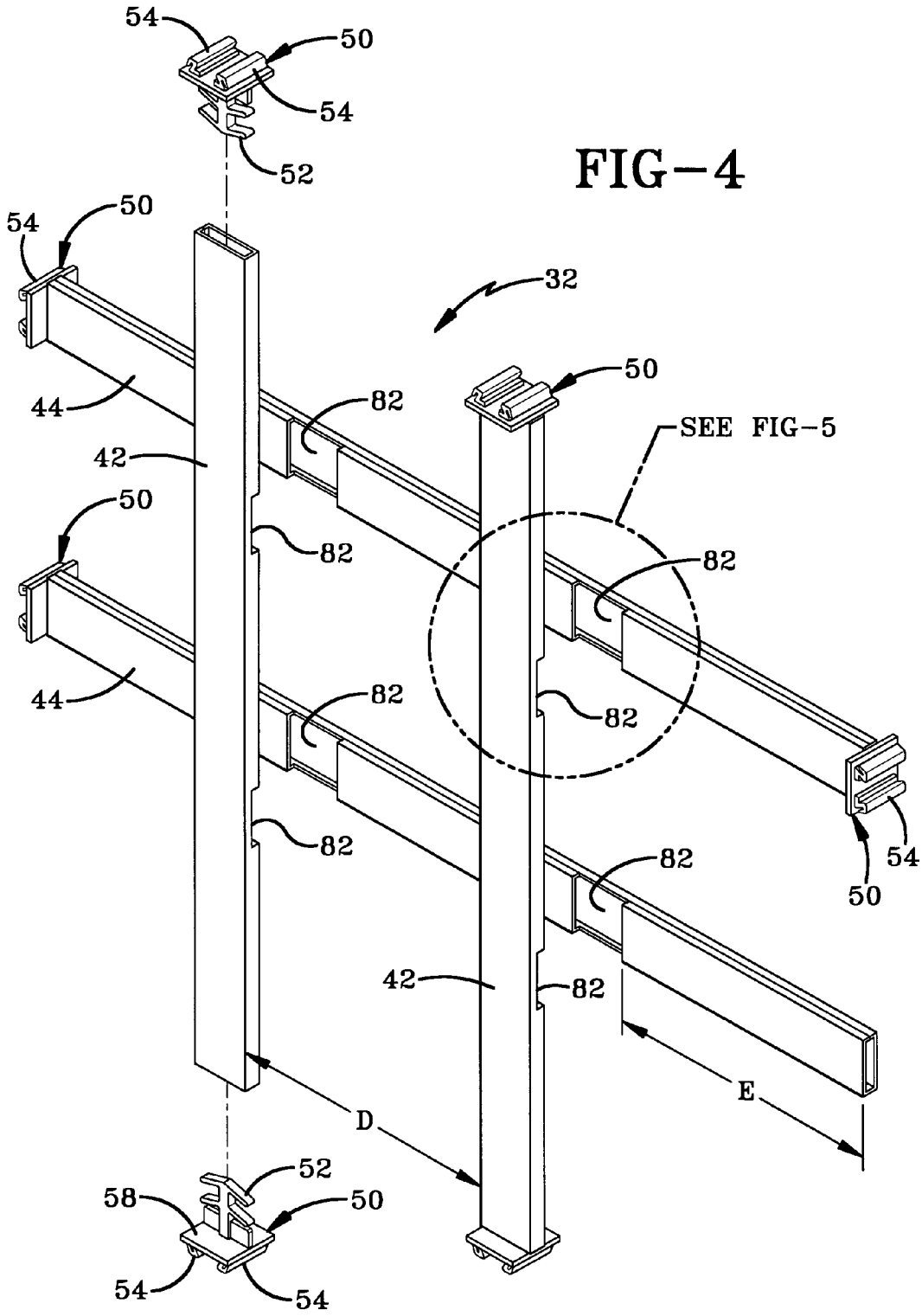
FIG. 4 is an exploded perspective view of the muntin bar grid of FIG. 1.
Figure 5:
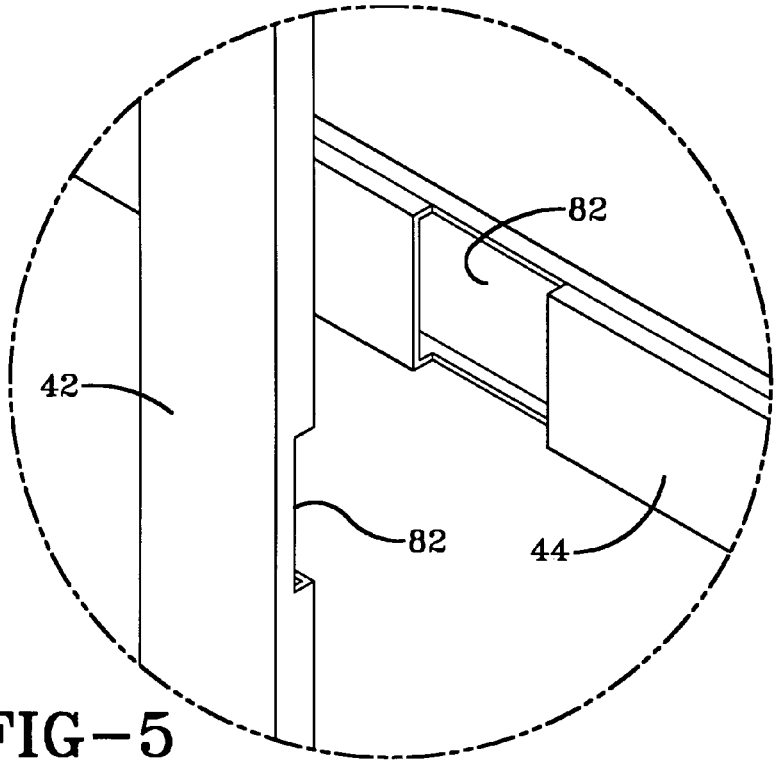
FIG. 5 is an enlarged perspective view of the encircled portion of FIG. 4.
Figure 6:
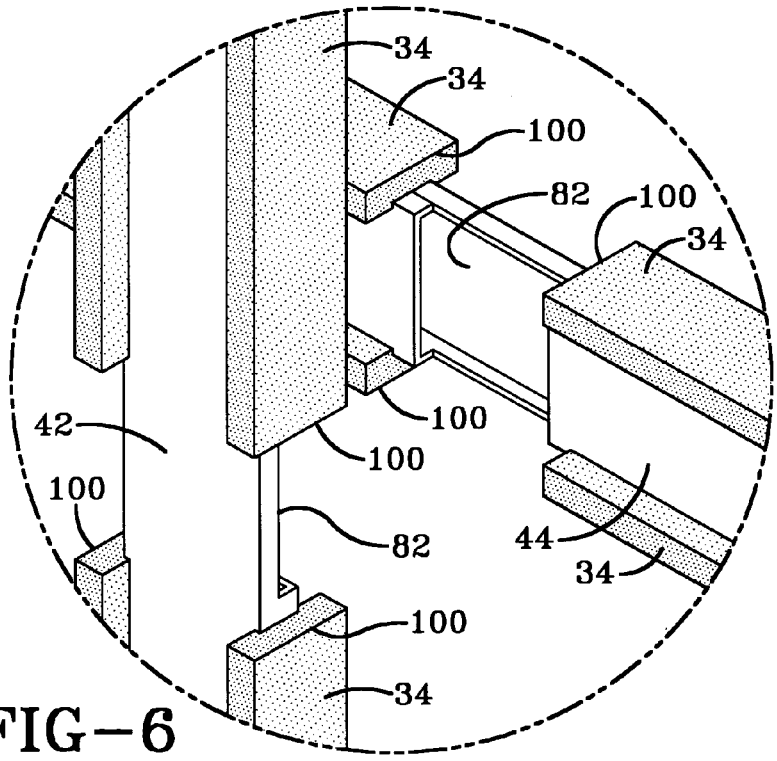
FIG. 6 is a view similar to FIG. 5 showing the material strips applied to the muntin grid elements before the grid is assembled.
Figure 7:
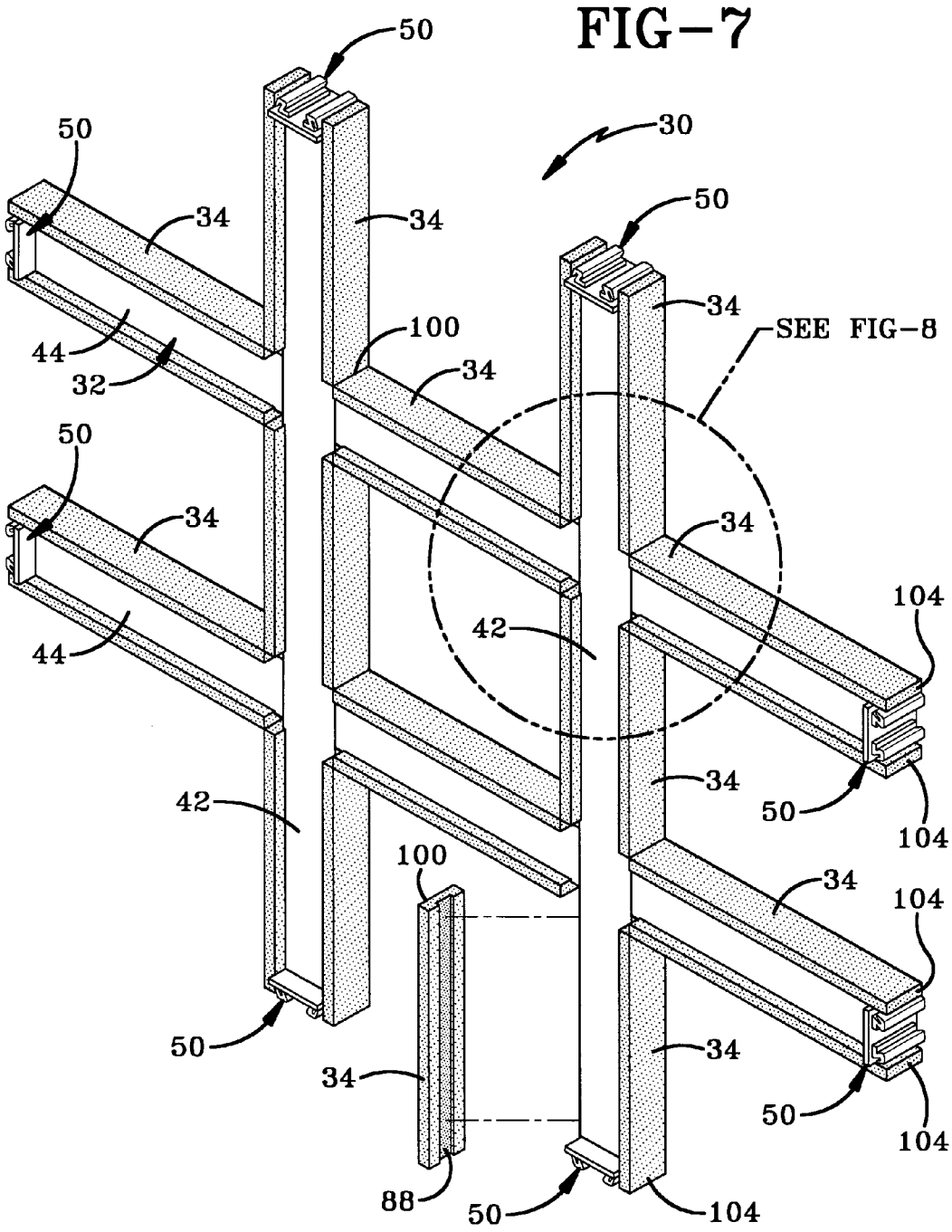
FIG. 7 is a perspective view of a muntin bar grid fabricated with the method of the present invention.

An exploded view of inner muntin grid 32 is depicted in FIG. 4 in combination with the muntin clips 50 that are used to secure muntin bar grid 30 to spacer 22. Each clip 50 includes an attachment leg 52 that is frictionally received in the end of muntin grid element 42 or 44. Each clip 50 further includes a pair of hooks 54 that are each sized and configured to be received in cutouts 56 in spacer 22. Each clip 50 further includes a plate 58 that supports attachment leg 52 and hooks 54. Plate 58 rests on the upper surface 60 of spacer 22 when clips 50 are installed. In the past, plates 58 were readily visible after a window using clips 50 was assembled.

Figure 12:
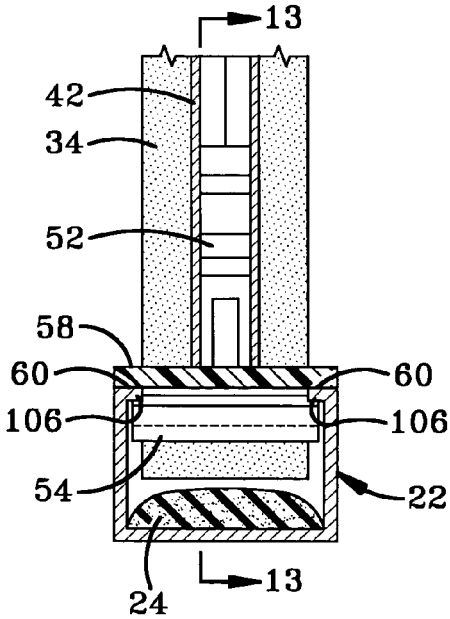
FIG. 12 is a sectional view taken along line 12-12 of FIG. 11.

In one embodiment of the invention, each muntin grid element 42 and 44 is preferably fabricated from raw metal stock that is roll formed to have a substantially hollow rectangular cross section as depicted in FIGS. 3 and 12. It should be noted that some window configurations may only have a single muntin bar instead of a plurality of intersecting bars. The roll forming apparatus used to fabricate muntin grid elements 42 and 44 and the operation of the apparatus is known to those skilled in the art. The roll forming equipment allows the operator to input a window size either manually or it receives a window size as part of a large order that has been fed into a control computer ahead of time. The computer has at least a CPU, a storage device such as a disk drive, and memory that have programs or other instructions saved thereon that receive the inputted data and perform calculations on the data to provide instructions to the roll forming apparatus. The computer allows the user to input a grid pattern, allows the user to select a grid pattern from pre-defined selections, or automatically sizes the grid from preset criteria. The grid selected for the window may have a number of vertical elements 42 and a number of horizontal elements 44 that must be punched, roll formed, and cut to length so that they can be fit together in grid form.

Figure 14:
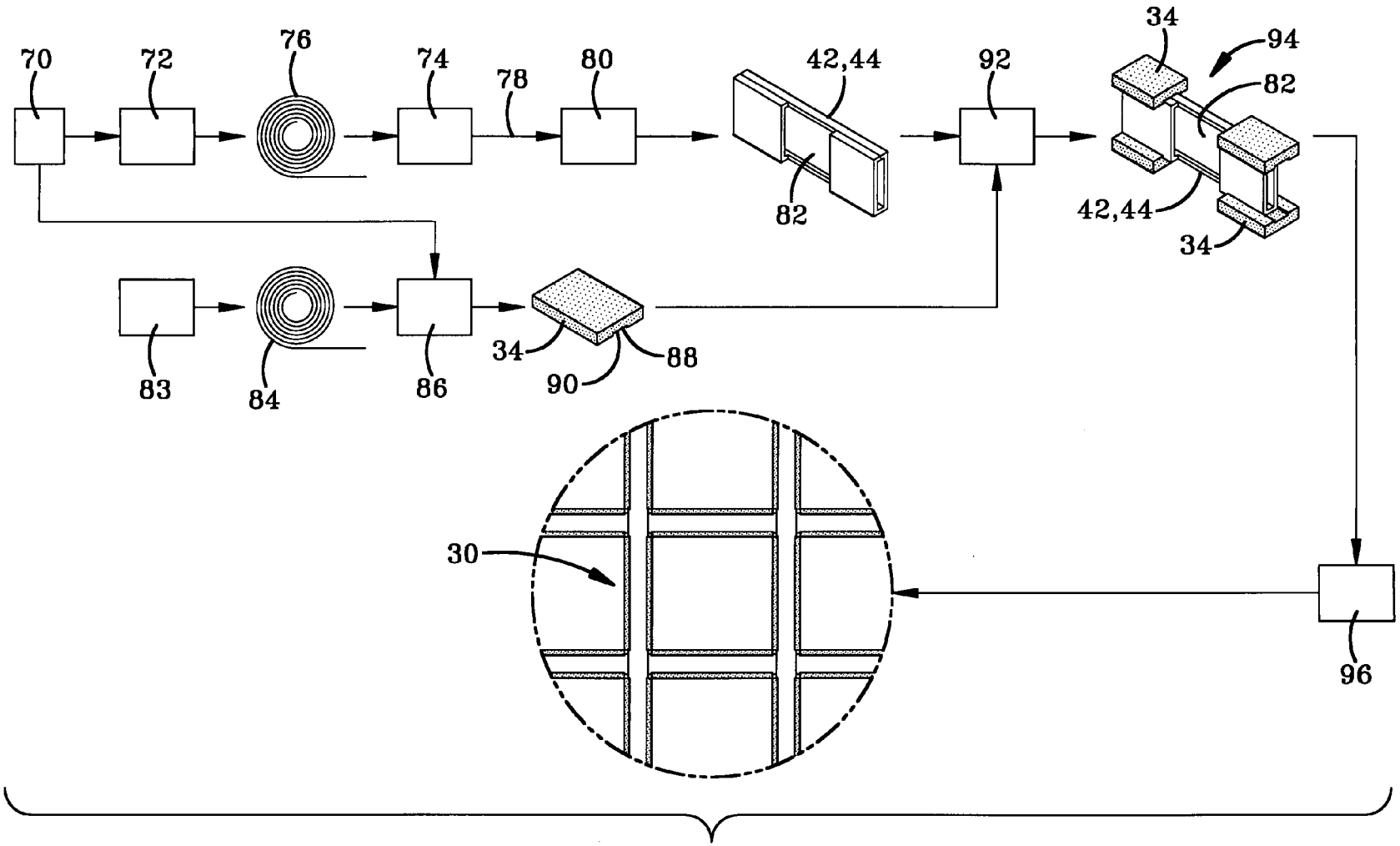
FIG. 14 is a schematic view showing the method of manufacturing the muntin bar grid according to one embodiment of the present invention.

A schematic view of this process is depicted as part of FIG. 14. In FIG. 14, a controller or computer 70 is provided that controls the formation of elements 42 and 44. A supply of raw material 72 is provided and is fed into punching equipment 74. For instance, raw material 72 may be a coil of metal stock 76. In other embodiments, raw material 72 may be a supply of other material that may be roll formed and may be stored in configurations other than rolled coils. Punching equipment 74 is controlled by controller 70 to punch openings in the raw material before the raw material is roll formed. The openings are precisely located to form notches 82 that allow muntin grid elements 42, 44 to be fit together in grid form. Punched material 78 is then roll formed by roll forming apparatus 80 resulting in muntin grid elements 42, 44. The material may be cut to length before or after roll forming. Suitable attachment devices fit within notches 82 to connect elements 42 to elements 44. In the past, elements 42 and 44 had to be deburred and painted before grid 32 was assembled. These processes are expensive and increase the fabrication time. In addition, the painted elements had to be carefully handled to avoid scratching and chipping.

Muntin grid elements 42 and 44 are manually assembled into grid 32 after they are fabricated. In the prior art, material strips 34 were fabricated and manually applied to the outer surfaces of muntin grid elements 42 and 44 to form muntin bar grid 30 only after grid 32 was formed. In the present invention, equipment is provided that cooperates with the equipment used to form elements 42 and 44 that automatically forms material strips 34. In one embodiment, the equipment automatically applies material strips 34 to elements 42 and 44 so that grid 30 may be created simply by connecting elements 42 and 44 together into the proper grid pattern.

A supply of raw material strip stock 83 is supplied preferably in the form of a coil 84 that is fed into a cutting apparatus 86. Cutting apparatus 86 is in communication with controller or computer 70 and the window data used to form elements 42 and 44 is used to control cutter 86 to provide material strips 34 of the proper length to be used to form grid 30.

Material strips 34 are preferably formed from a flexible foam material. Other materials known in the art may also be used to form strips 34. Material strips 34 may carry a desiccant to adsorb moisture. Material strips 34 preferably may be provided with an inwardly facing channel 88 that is used to position material strip 34 on grid element 42 or 44. In one embodiment, an adhesive 90 is located in channel 88 to connect material strip 34 to element 42 or 44. Adhesive 90 may be pressure sensitive adhesive or any of a variety of adhesives known in the art. Material strips 34 may also be provided in a variety of colors allowing the window manufacturer to select different looks for its windows. In another embodiment, a mechanical connection is formed between strips 34 and the elements as is described below.

In the embodiment of the invention depicted in FIG. 14, a laminating machine 92 is provided that automatically joins material strips 34 to elements 42, 44 after material strips 34 and elements 42, 44 are formed. This results in a muntin grid piece 94 that is a combination of one element 42, 44 and two material strips 34. Grid pieces 94 need only be assembled during an assembly step 96 to form grid 30. In another embodiment of the invention, laminating machine 92 is replaced by a manual step where the manufacturer manually applies material strips 34 to element 42, 44 to provide pieces 94.

The dimensions of window 10 or 12 and the selected grid pattern allow controller 70 to automatically calculate the lengths of material strips 34 as well as the total number of strips 34 that are required to form grid 32. Controller 70 determines the length of each strip 34 by first determining whether or not the location of strip 34 is an internal location (between grid intersections) or an external location (between a grid intersection and spacer 22). For internal material strips 34, the length is calculated by taking the total distance "D" between the edges of adjacent grid elements (such as adjacent vertical grid elements 42 depicted in FIG. 4) and subtracting twice the thickness "T" of material strip 34 between its outer surface and the inner surface of channel 88. Calculating the length in this manner and properly positioning material strips 34 on elements 42 and 44 locates the outer corners 100 of material strips 34 adjacent one another to form a continuous corner that is visible to a person looking at grid 30. This method also saves material by leaving spaces 102 at each corner. For instance, if dimension "T" is one eighth of an inch, one inch of material is saved at each joint intersection because eight material strips 34 are used.

Figure 10:
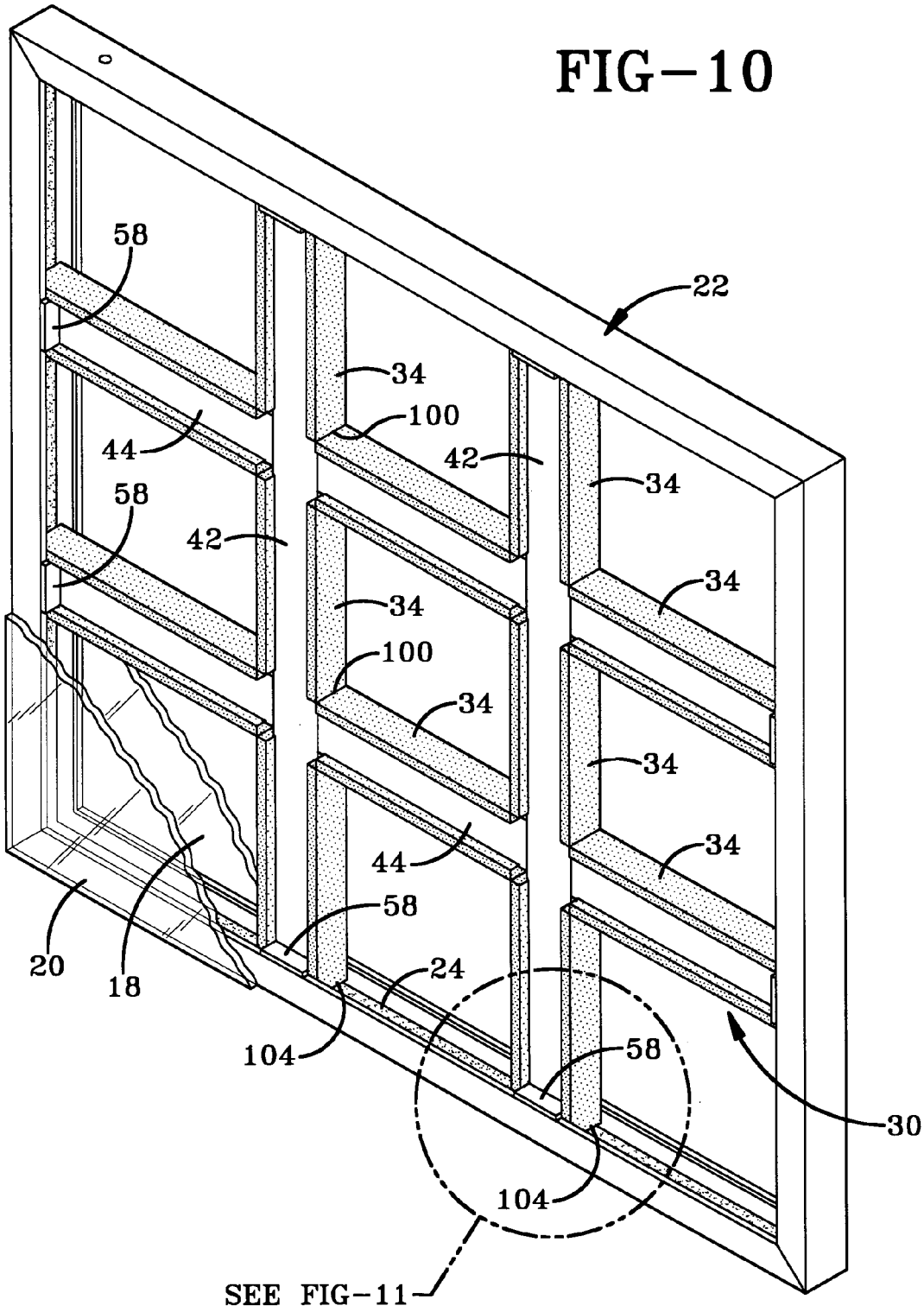
FIG. 10 is a perspective view of an insulating glazing unit with the glass sheets broken away showing the material strip flaps disposed in the spacer.
Figure 11:
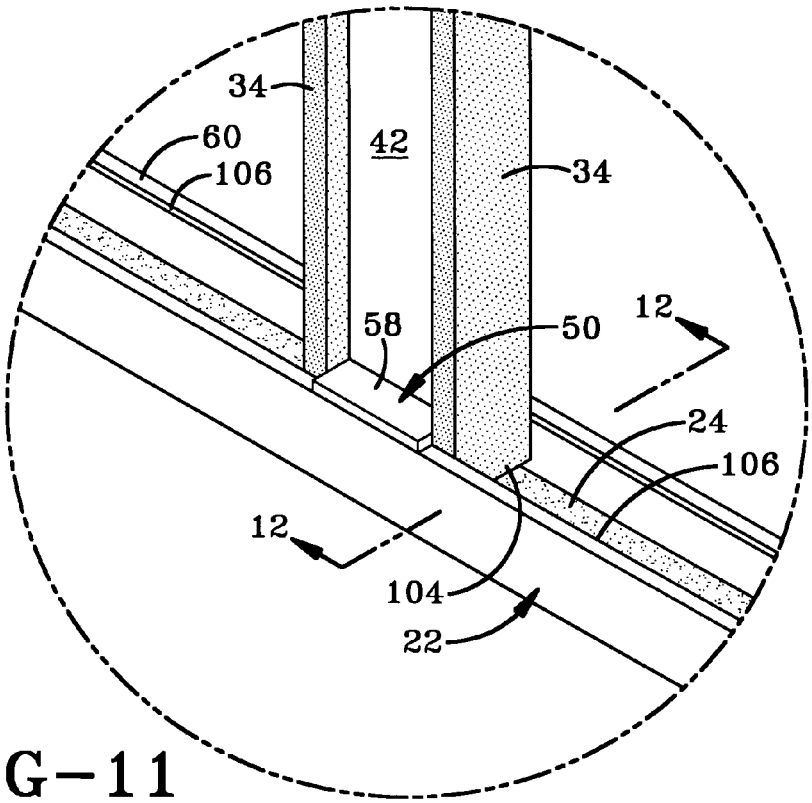
FIG. 11 is an enlarged perspective view of the encircled portion in FIG. 10.
Figure 13:
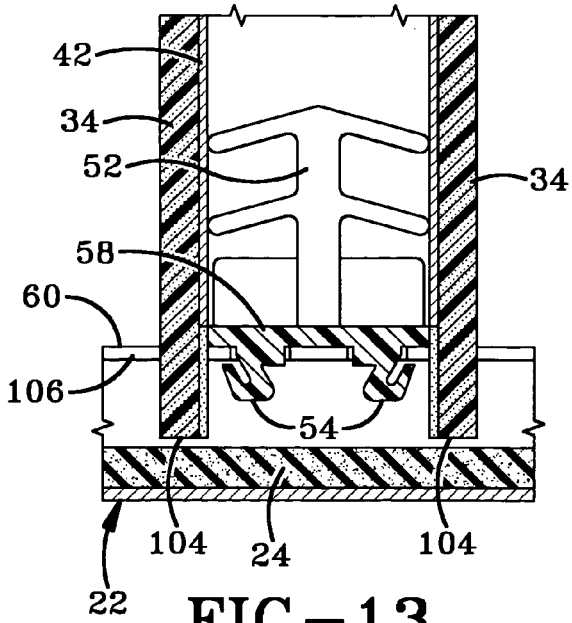
FIG. 13 is a sectional view taken along line 13-13 of FIG. 12.
Figure 11A:
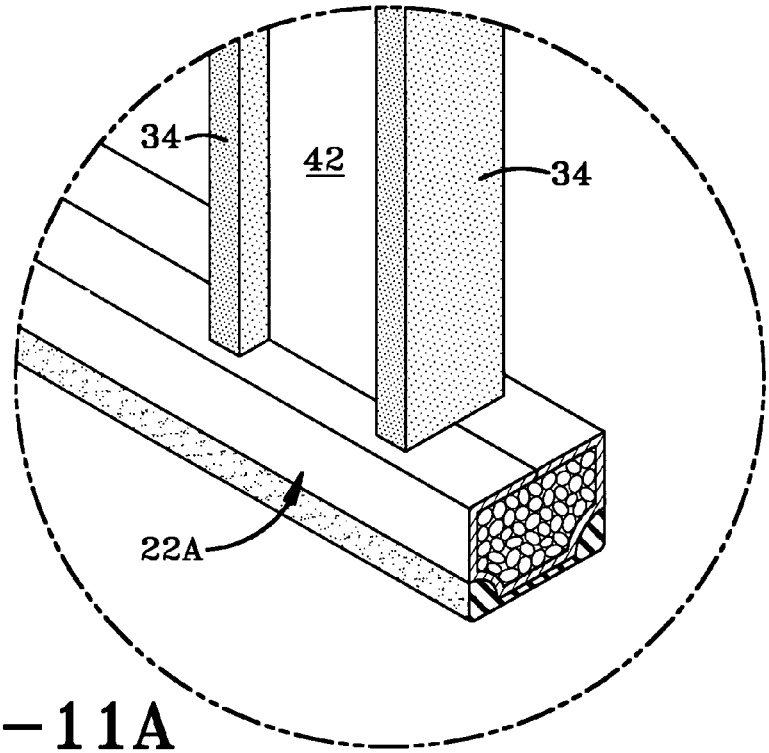
FIG. 11A is a view similar to FIG. 11 showing the muntin bar used with a traditional metal spacer.
Figure 11B:
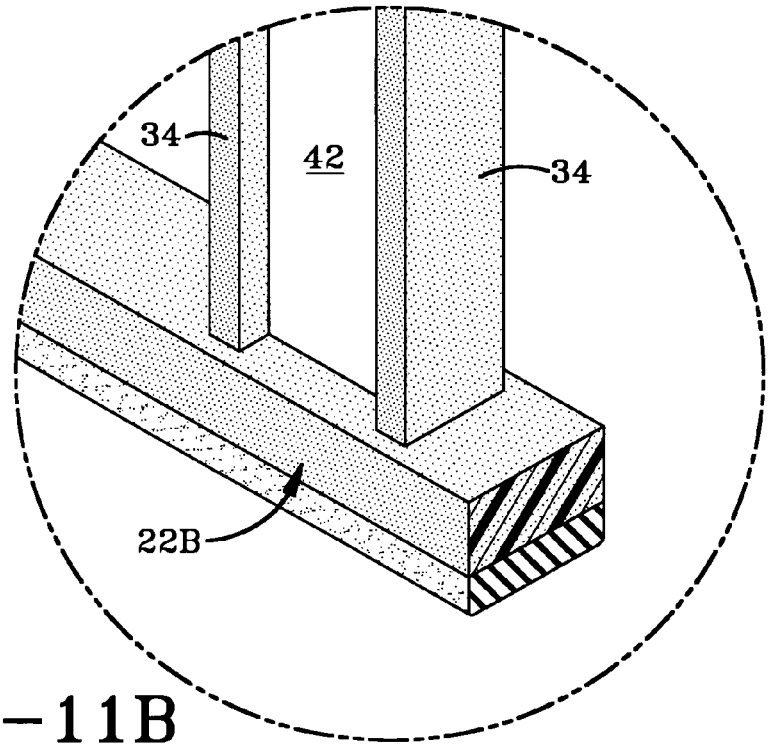
FIG. 11B is a view similar to FIG. 11 showing the muntin bar used with a foam spacer.

When cutting an external material strip 34, the length dimension is simply calculated by subtracting the one thickness T from the dimension E (for example, the external dimension E in FIG. 4) taken from the end of grid element 42 or 44 to the edge of notch 82. This dimension calculation is used if the manufacturer desires material strips 34 to end flush with the end of element 42, 44 as shown in FIGS. 11A and 11B. Another dimension calculation is performed in an alternative embodiment when the manufacturer wants material strips 34 to have flaps 104 that extend past plates 58 of clips 50 and into spacer 22. Flaps 104 are desired in the art because they block the sides of clips 50 from view as shown in FIGS. 10 and 11 and visually join the muntin bar with the desiccant matrix 24 disposed in spacer 22. When material strips 34 are fabricated to be the same color as desiccant matrix 24, flaps 104 provide a smooth, continuous look to window 10 or 12 by eliminating visual breaks between grid 30 and spacer 22. The specific dimension of flap 104 is not critical to the invention. Flap 104 need only extend into spacer 22 and cover at least plate 58 although it is desired that flap 104 be long enough to cover the view of hooks 54. In the preferred embodiment, flap 104 is dimensioned so that it is closely adjacent matrix 24 as shown in FIGS. 12 and 13.

It may be understood that flaps 104 may fit within spacer 22 because material strips 34 are fabricated to have an overall width that is somewhat less than the total width between the interior surfaces of glass sheets 18 and 20 as depicted in FIG. 3. Material strips 34 thus fit in between the flanges 106 of spacer 22. In some cases, flanges 106 may contact material strip 34 or may cause the edges of material strip 34 to be crimped.

Figure 15:
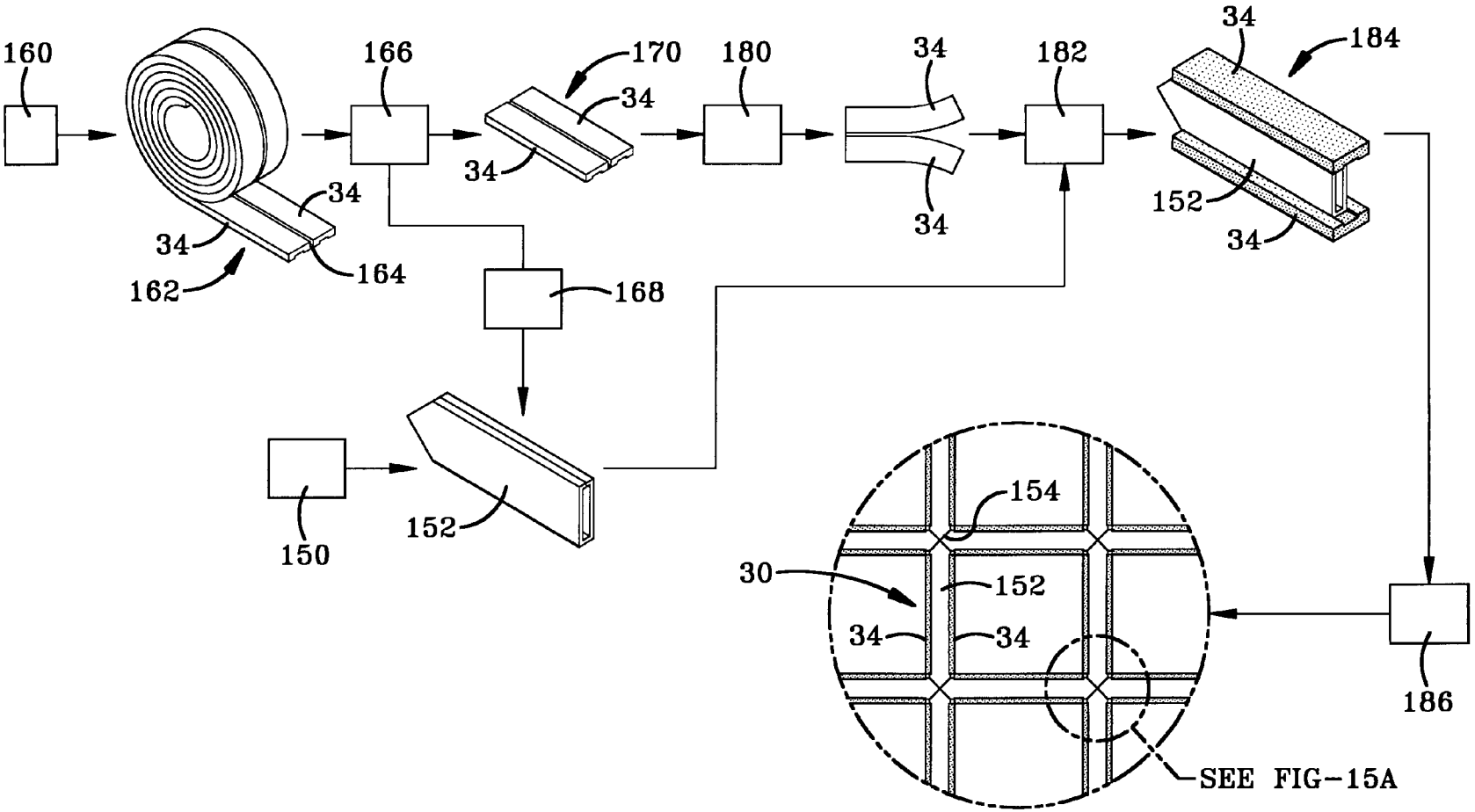
FIG. 15 is a schematic view of the method of manufacturing a muntin bar grid according to another embodiment of the present invention.

Another embodiment of the method of the present invention is depicted schematically in FIG. 15. In this embodiment, a supply 150 of muntin grid elements 152 is provided. Supply 150 provides enough muntin grid elements 152 so that grid 30 may be fabricated. Muntin grid elements 152 may be the same as elements 42, 44 described above or may be any of a variety of muntin grid elements known in the art. Such known muntin grid elements may not use notches 82 at the intersections. In one example, each end of element 152 is tapered as at 154 so that four elements 152 fit together smoothly at an intersection. In other embodiments, a cross-shaped clip (not shown) is used to hold elements 152 together at the intersections. The clip is designed to form a smooth connection between the ends of elements 152.

Figure 21:
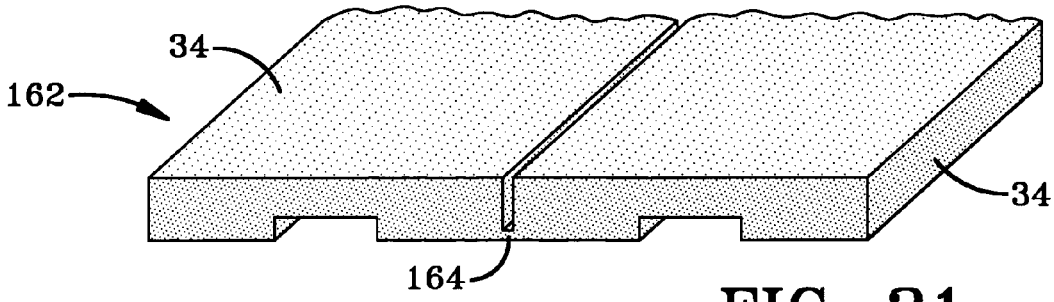
FIG. 21 is an end view of the material strips joined together in pairs.

A supply of material strip stock 160 is provided with the stock 162 including two lengths of material strip 34 joined at an inner corner 164 (see FIG. 21). Stock 162 allows material strips 34 to be formed in essentially identical pairs that are applied to opposed edges of elements 152. Fabricating stock 162 in the dual configuration depicted in FIG. 21 also allows twice as much stock 162 to be fabricated in essentially the same amount of time.

Stock 162 is next cut to length with a cutting apparatus 166. Cutting apparatus 166 may be in communication with a controller that is programmed with the grid configuration and to provide the cut dimensions to cutting apparatus 166. However, in the method depicted in FIG. 15, cutting apparatus 166 is in communication with a measuring apparatus 168 that measures elements 152 as they are presented. Measuring apparatus 168 measures the length of element 152 and provides the length to cutting apparatus 166 that then cuts stock 162 into lengths 170 of joined material strips. Either cutting apparatus 166 or measuring device 168 may perform the calculations to provide spaces 102 or flaps 104.

Lengths 170 are then separated into individual material strips 34 by an appropriate device 180. Any of a variety of separation devices 180 may be used to separate strips 34. For instance, lengths 170 may be run through a dividing element, such as a pin or blade, that breaks the connection between strips 34. Separated strips 34 are then positioned on opposed edges of element 152 and are connected thereto by a laminating apparatus 182. This method thus allows material strips 34 to be simultaneously cut and simultaneously applied. The resulting muntin grid piece 184 may be assembled at an assembly step 186 into grid 30.

One advantage of providing joined stock 162 is that only a single roll of stock 162 needs to be replaced at a time thus eliminating the downtime in practicing the method. Another advantage is when material strips 34 contain desiccant. In this situation, only one roll of stock is exposed to the air at a time thus allowing the desiccant to be more effective when installed in window 10 or 12. Another advantage is that the opposed lengths of material strip 34 are accurately cut because they are being simultaneously cut. The method is also faster because strips 34 are being simultaneously formed and simultaneously applied to the opposed edges of element 152. The method does not require element 152 to wait while the second strip is fabricated and then applied.

Figure 15A:
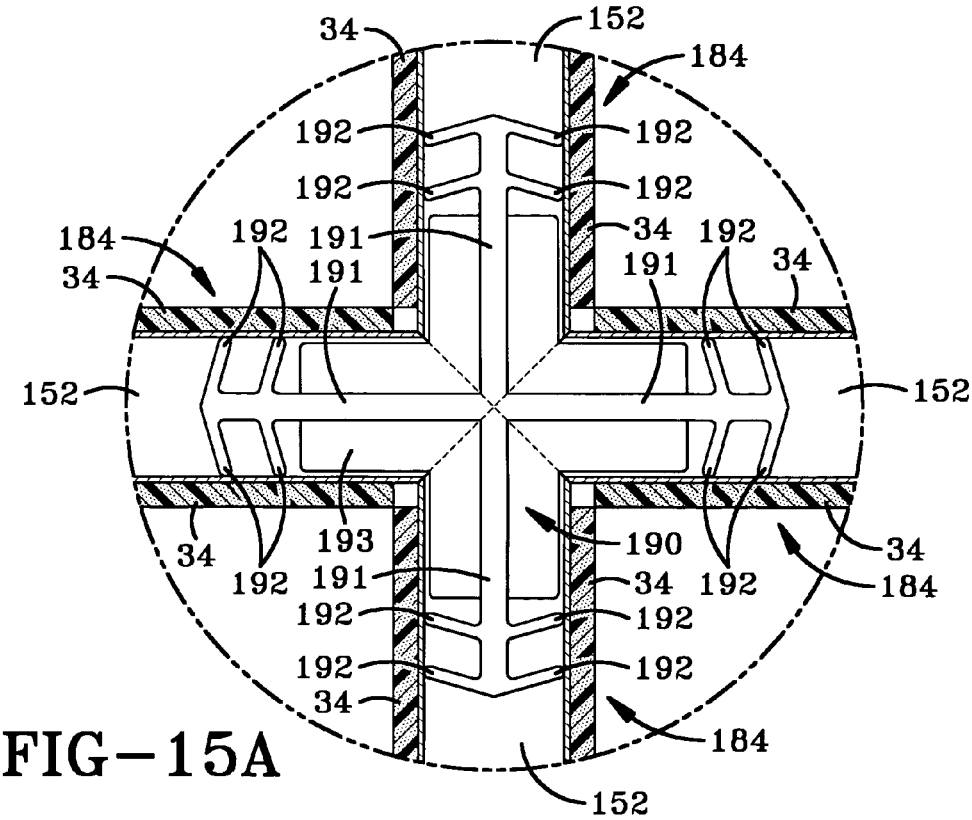
FIG. 15A is a sectional view of an intersection showing a cross connector holding four muntin bar sections together.
Figure 15B:
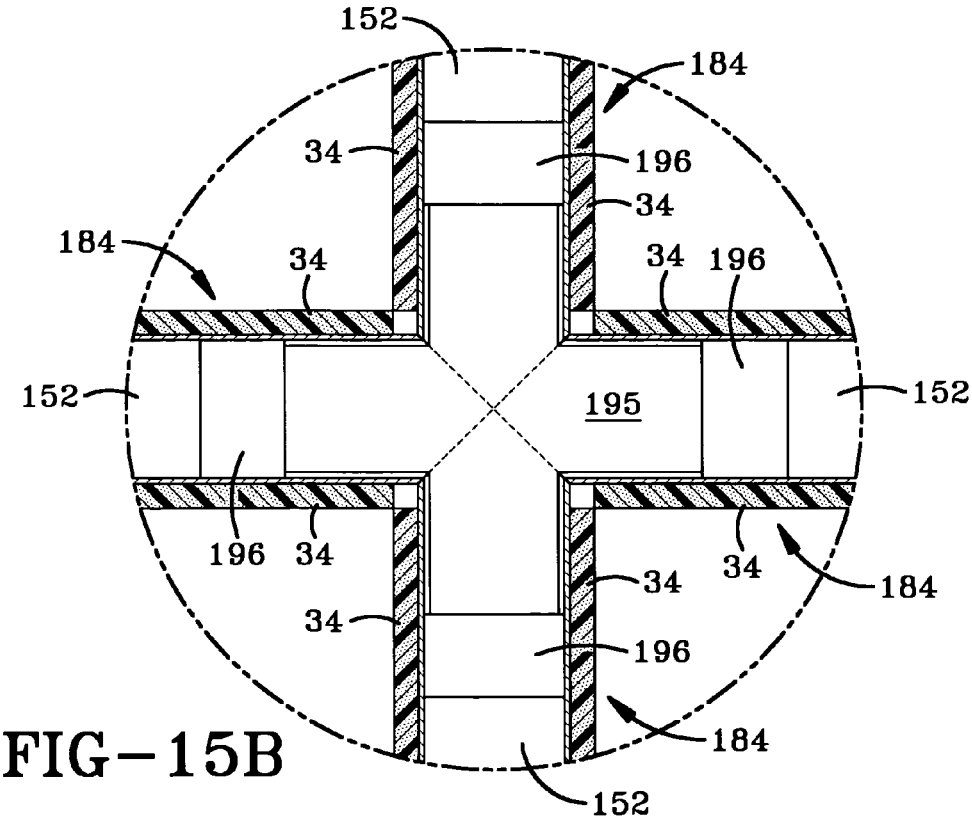
FIG. 15B is a sectional view showing an alternative cross connector construction.

FIGS. 15A and 15B show alternative cross connectors that may be used to connected muntin grid pieces 184 into grid 30. Cross connector 190 of FIG. 15A includes four arms 191 that each include outwardly projecting fingers 192. Fingers 192 frictionally engage the inner surface of elements 152 to join pieces 184 together. Connector 190 may also include a body 193 that snugly fits within each element 152 to keep elements 152 perpendicular and square to each other. Cross connector 194 of FIG. 15B includes a cross-shaped body 195 that extends into each end of elements 152. A resilient protrusion 196 is disposed at the end of each arm of body 195. Protrusion 196 frictionally engages the inner surface of each element to hold elements square to each other. Protrusion 196 may be a foam material, a rubber material, or a resilient plastic material that has suitable frictional properties for holding elements 152 together.

Figure 16:
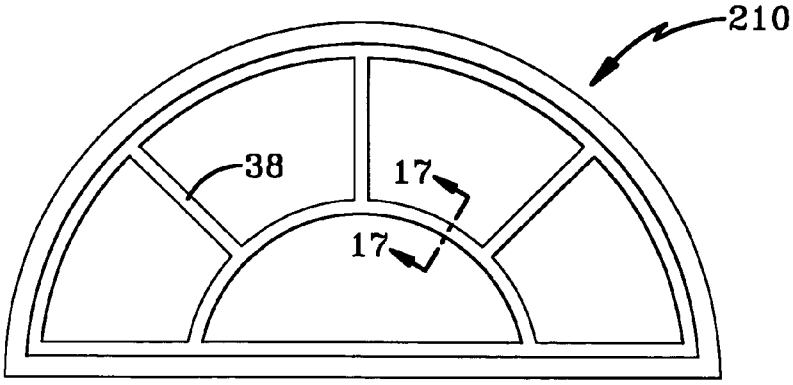
FIG. 16 is a front elevational view of a simulated divided lite window having curved muntin bars using a first alternative embodiment of the material strips.
Figure 17:
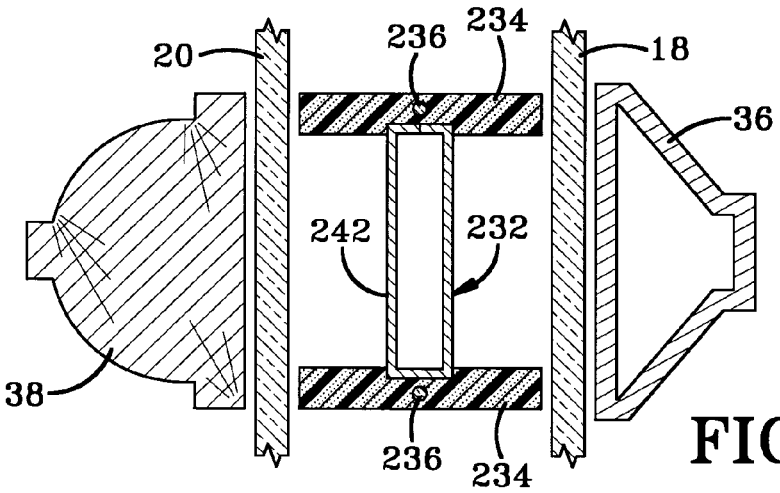
FIG. 17 is a sectional view taken along line 17-17 of FIG. 16.

A first alternative material strip configuration is generally indicated by the numeral 234 is FIGS. 16-17. Material strips 234 include at least one section of a non-extensible material 236 that prevents material strips 234 from stretching when applied to inner muntin grid 232. Although this feature is useful when material strips 234 are applied to straight muntin grid elements such as elements 42 and 44 described above, this feature is especially useful when material strips 234 are applied to the outside of curved muntin grid elements 242 as shown in FIGS. 16-17. When material strips 234 are stretched during application, they eventually relax back to their unstretched configuration and can become disconnected or delaminated from inner muntin grid 232. Such disconnected material strips degrade the appearance of window unit 210. The problem of stretching material strips during application may also occur when material strips are automatically laminated to elements 42 and 44 by laminater 92.

Figure 18:
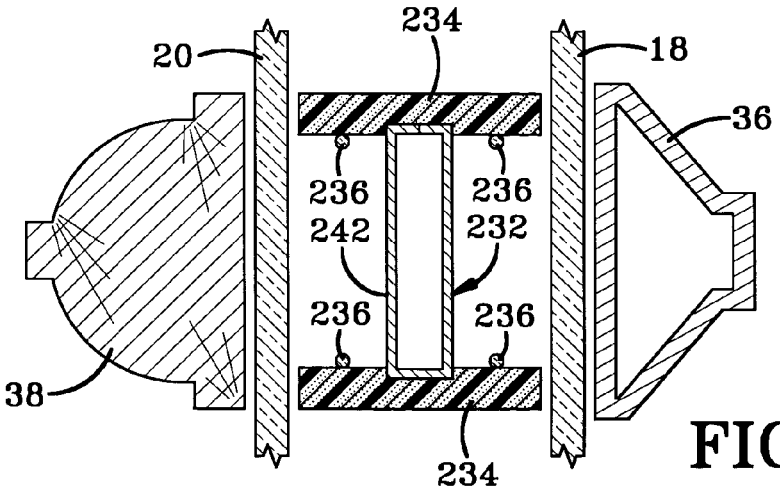
FIG. 18 is a view similar to FIG. 17 showing a second alternative embodiment of the material strips including a non-extensible material.

In the first alternative embodiment of the invention, material strip 234 has section of non-extensible material 236 embedded within the body of material strip 234. Section 236 may be substantially centered within the body of material strip 234 as depicted in FIG. 17. In the second alternative embodiment of the invention (FIG. 18), section 236 is disposed on the surface of material strip 234 and is combined with a second section 236 disposed on the other side of grid 232. Non-extensible material sections 236 may be preferably fabricated from a glass fiber material and combined with material strip 234 when material strip 234 is fabricated. Section 236 may also be fabricated from any of a variety of materials known in the art that will help prevent material strip 234 from stretching during application. It is desired that sections 236 extend substantially throughout the longitudinal lengths of material strips 234.

Figure 19:
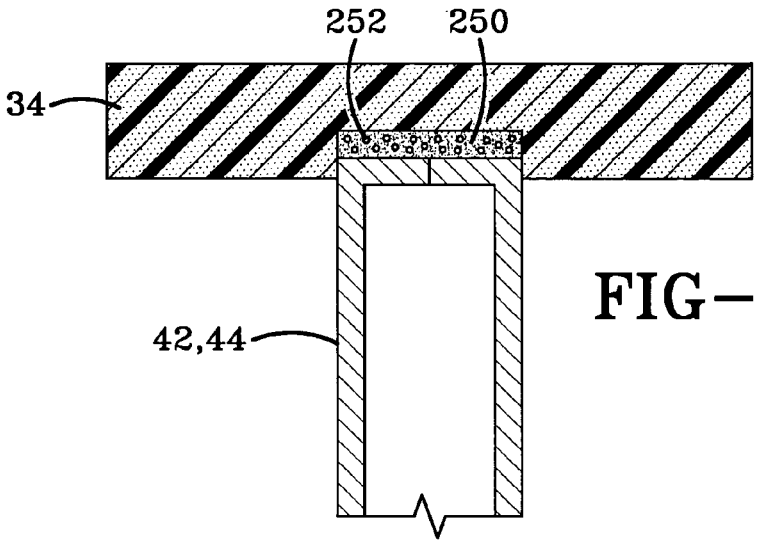
FIG. 19 is a view similar to FIG. 17 showing a third alternative embodiment of the material strips including a non-extensible material.

A third alternative embodiment is depicted in FIG. 19 where element 42, 44 is connected to material strip 34 with an adhesive 250 having a plurality of non-extensible fibers 252 disposed therein. Fibers 252 prevent material strip 34 from stretching during application of material strip 34 to element 42, 44. The specific orientation of fibers 252 within adhesive 250 is not critical to the invention. For instance, fibers 252 may all be longitudinally disposed, may be uniformly angled within adhesive 250, or may be overlapping in a cross-hatch pattern. Fibers 252 may also be randomly disposed in adhesive 250.

Figure 20:
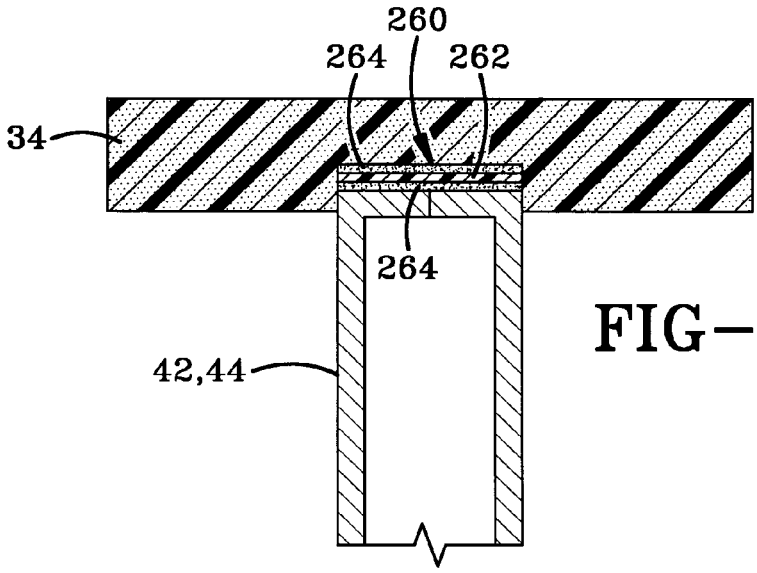
FIG. 20 is a view similar to FIG. 17 showing a fourth alternative embodiment of the material strips including a non-extensible material.

A fourth alternative embodiment is depicted in FIG. 20 where material strip 34 is connected to element 42, 44 by an adhesive assembly 260 having an inner non-extensible layer 262 coated with adhesive 264 on both sides. Layer 262 may be a Mylar material or any of a variety of other materials known in the art. Assembly 260 prevents material strip 34 from stretching during application to element 42, 44 because layer 262 does not stretch.

Another delamination problem occurs when the adhesive connecting the material strips to the muntin grid elements fails. The embodiments of the material strips depicted in FIGS. 22-26A prevent delamination caused by adhesive failure. Each of these embodiments may be used with or without adhesive.

Figure 22:
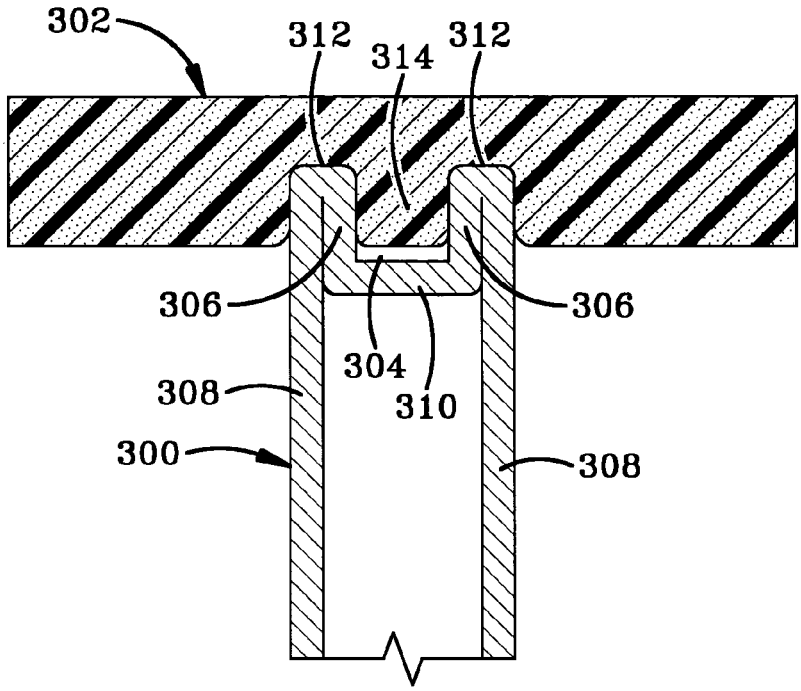
FIG. 22 is a view similar to FIG. 19 showing a first alternative embodiment of the material strips and muntin bars wherein a mechanical connection is created between the material strip and the muntin bar.
Figure 22A:
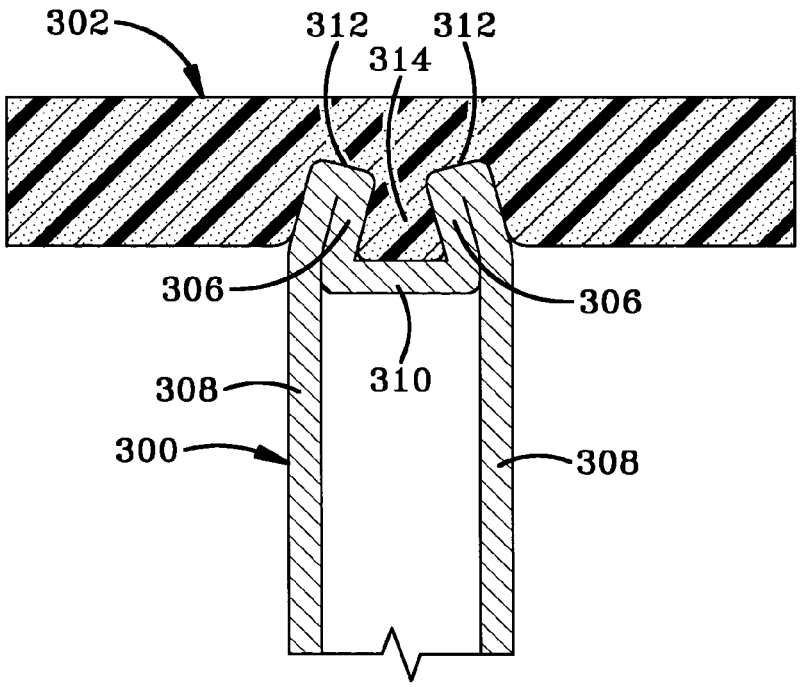
FIG. 22A is a view of the muntin bar and strip of FIG. 22 after the ends of the muntin bar have been crimped.

A first alternative embodiment of the material strips and muntin grid element wherein a mechanical connection is created between the material strip and muntin grid element is depicted in FIGS. 22 and 22A. In this embodiment, the inner muntin grid element is connected to the material strip with a mechanical connection that may or may not be combined with an adhesive connection. The mechanical connection prevents delamination of the material strip from the grid element due to adhesive failure.

In FIG. 22, the grid element is indicated by the numeral 300 and the material strip is indicated by the numeral 302. Only half (one edge) of grid element 300 is depicted in FIG. 22 and only one material strip 302 is depicted in FIG. 22 so that the detail of the connection may be seen. FIG. 22 represents about half of a mirror image wherein the lower portion of grid element 300 is substantially identical to the upper half depicted in the drawings. As such, a second material strip 302 is connected to the lower half of grid element 300 in a similar fashion.

Grid element 300 includes a channel 304 formed along both of its edges by folding back two arms 306 against the sidewalls 308. Grid element 300 also includes a base wall 310 that extends between arms 306 and forms the bottom of channel 304.

Material strip 302 defines a pair of spaced channels 312 that are configured to receive the folded edges of grid element 300. Channels 312 are defined by a protrusion 314 formed in the center of the bottom wall of material strip 302. Protrusion 314 is configured to fit snugly or frictionally within channel 304 so that material strip 302 may be mechanically connected to grid element 300 without the use of adhesive. In some embodiments, the manufacturer may wish to place an adhesive in channel 304 to form a mechanical and adhesive connection between grid element 300 and material strip 302.

In some applications, the manufacturer may wish to create a stronger connection between material strip 302 and grid element 300. In these situations, the manufacturer crimps the edges of sidewalls 308 toward each other as depicted in FIG. 22A. The crimping pinches protrusion 314 in channel 304 and forms a stronger mechanical connection between grid element 300 and material strip 302. The crimping may be achieved by running forming wheels against the edges of sidewalls 308 where sidewalls 308 engage material strip 302.

Figure 23:
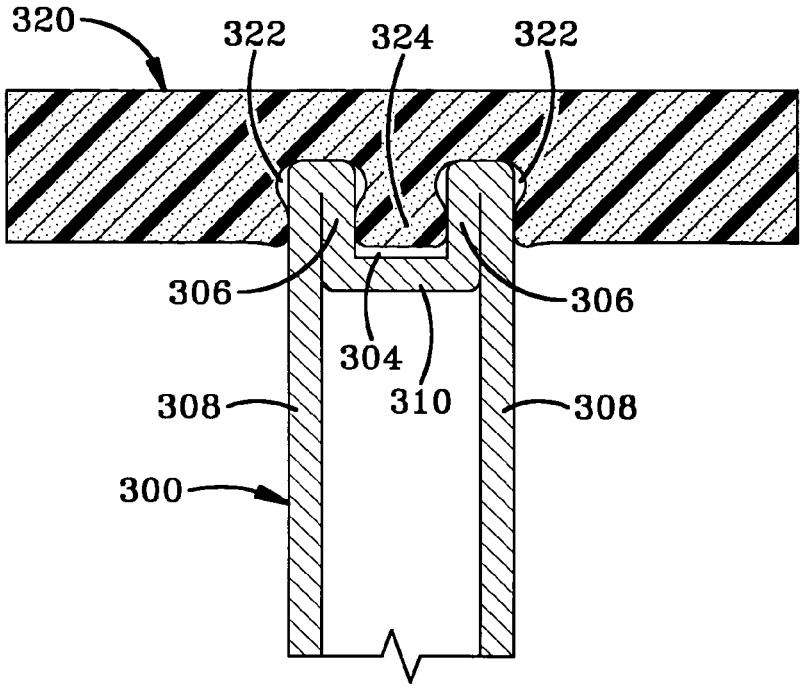
FIG. 23 is a view similar to FIG. 22 showing a second alternative embodiment of the material strips and muntin bars wherein a mechanical connection is created between the material strip and the muntin bar.

A second alternative embodiment of the material strip and muntin grid element is depicted in FIG. 23. In this embodiment, grid element 300 remains substantially the same as described above with respect to the first embodiment of the mechanical connection. In this embodiment, the material strip is indicated by the numeral 320. Material strip 320 also defines a pair of channels 322 that receive the edges of sidewalls 308. Channels 322 each have an opening having a width smaller than the thickness of the combination of arm 306 and sidewall 308 such that the body of material strip 320 must be deformed for grid element 300 to be fit into channels 322. As described above, material strip 320 is fabricated from a resilient material and a deformation of the resilient material creates a resilient force against arms 306 and sidewalls 308. Channels 322 preferably include a base area having a width larger than the combination of arm 306 and sidewall 308 so that grid element 300 is not readily forced out of channels 322 by the resilient force.

Figure 24:
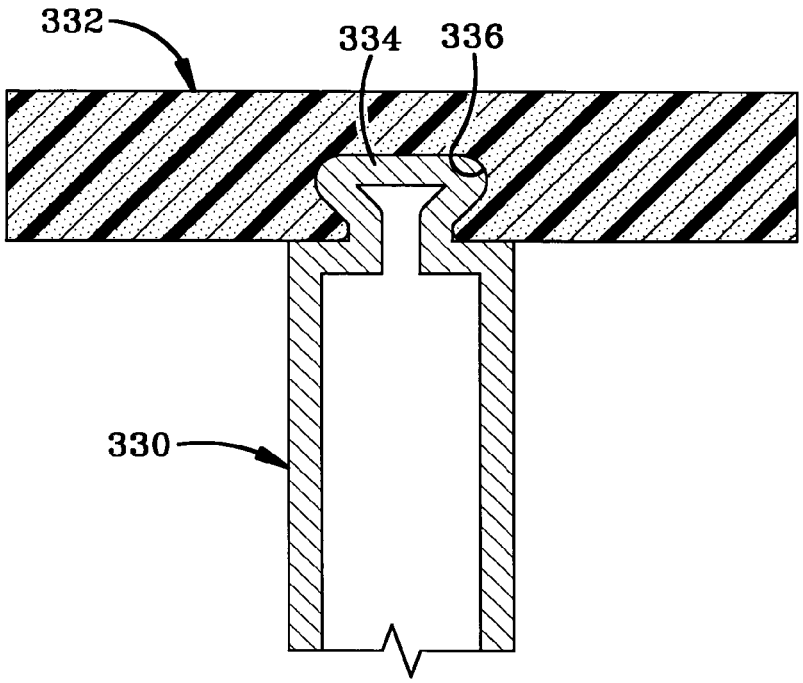
FIG. 24 is a view similar to FIG. 22 showing a third alternative embodiment of the material strips and muntin bars wherein a mechanical connection is created between the material strip and the muntin bar.

FIG. 24 depicts a third alternative embodiment of the material strips and muntin grid elements wherein a mechanical connection connects the material strips to the grid elements. In this embodiment, the grid element is indicated by the numeral 330 with the material strip being indicated by the numeral 332. Grid element 330 includes a protrusion 334 having a cross section in the shape of a male dovetail. Material strip 332 defines a channel 336 having a cross shape of the female dovetail configured to compliment the cross section of protrusion 334. Although the dovetail connection depicted in FIG. 24 has angled walls similar to a traditional dovetail, the dovetail connection may be rectangular, round, or triangular without departing from the concepts of the present invention. The dovetail connection between protrusion 334 and channel 336 provides a mechanical connection between grid element 330 and material strip 332 that prevents delamination. Material strip 332 is fabricated from a material resilient enough to snap around protrusion 334 when material strip 332 is initially installed.

Figure 25:
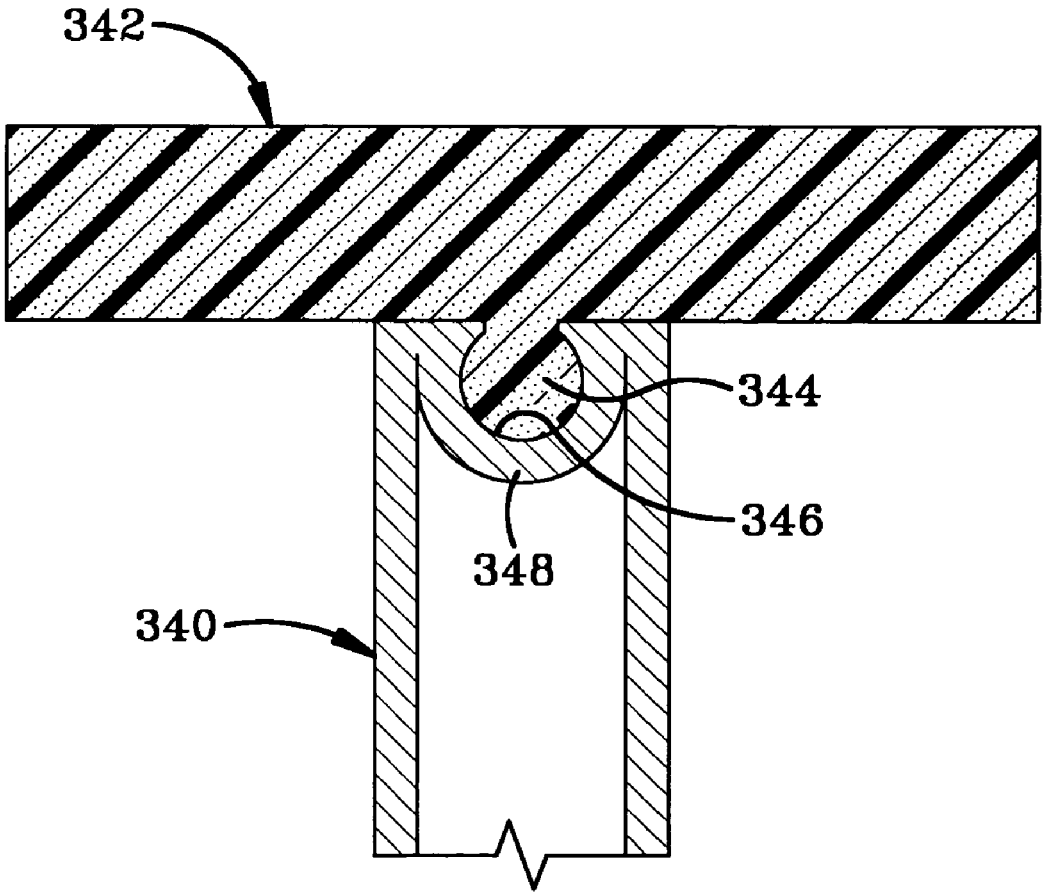
FIG. 25 is a view similar to FIG. 22 showing a fourth alternative embodiment of the material strips and muntin bars wherein a mechanical connection is created between the material strip and the muntin bar.

A fourth alternative embodiment of the material strip and grid element is depicted in FIG. 25. In this embodiment, the grid element is indicated by the numeral 340 with the material strip being indicated by the numeral 342. Material strip 342 includes a protrusion 344 that is received in a channel 346 defined by a wall 348 formed in the edge of grid element 340. Protrusion 344 and channel 346 are dovetailed in a manner similar to that described above with respect to FIG. 24 except that the male dovetail element extends from material strip 342 with the female dovetail element being formed in grid element 340. In this embodiment, the dovetail elements have a round cross section.

Figure 26:
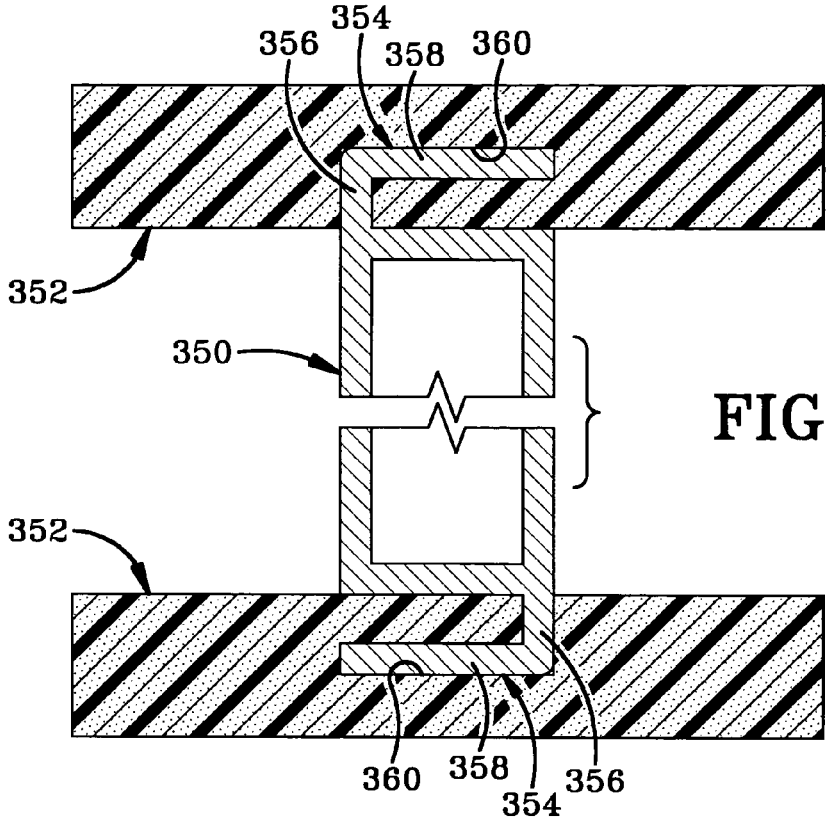
FIG. 26 is a view similar to FIG. 22 showing a fifth alternative embodiment of the material strips and muntin bars wherein a mechanical connection is created between the material strip and the muntin bar.
Figure 26A:
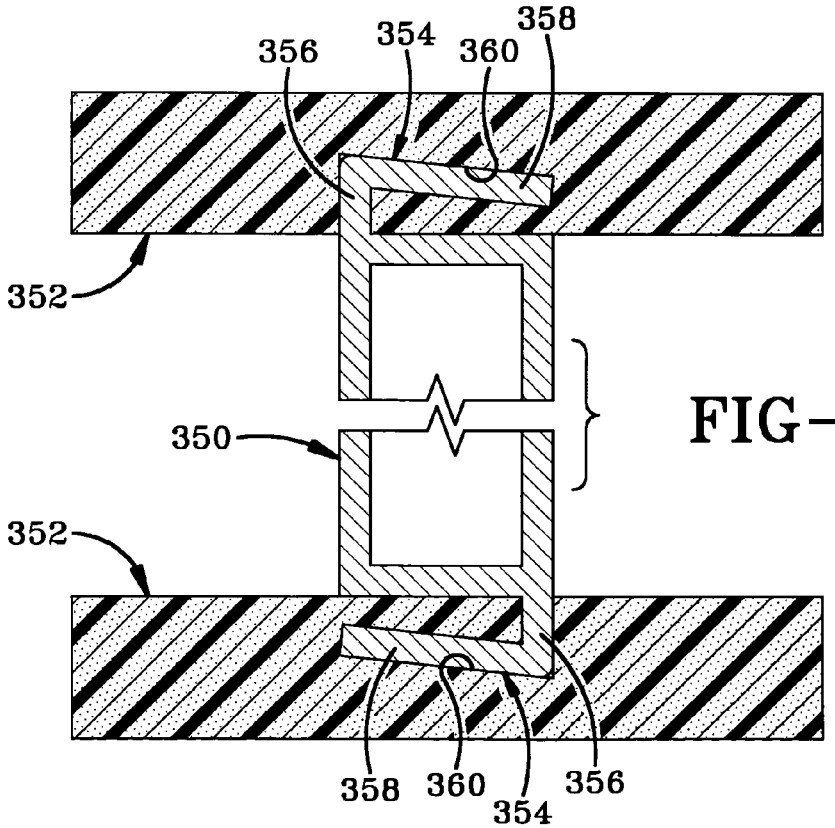
FIG. 26A is a view of the muntin bar and strip of FIG. 26 after the ends of the muntin bar have been crimped.

FIGS. 26 and 26A depict a fifth alternative embodiment of the material strips and grid elements wherein a mechanical connection secures the two elements together. In this embodiment, the grid elements are indicated by the numeral 350 with the material strips being indicated by the numeral 352. Grid element 350 includes a projecting arm 354 that extends up away from the main body of grid element 350 with a first portion 356 and back across with a second portion 358 that extends substantially perpendicular to first portion 356. Arm 354 is received in a complimentary channel 360 defined by material strip 352. Material strip 352 is flexible and resilient enough to allow arm 354 to be slid or hooked into channel 360. A mechanical connection is formed once arms 354 are received in channels 360 as depicted in FIG. 26.

The manufacturer may crimp arms 358 inwardly toward the main body of grid element 350 as depicted in FIG. 26A to secure the mechanical connection. The crimping may occur in a variety of ways that apply force against arms 358.

Alternative embodiments of muntin grid pieces are depicted in FIGS. 27A-27G. Each of these pieces include an outer muntin grid element that substantially surrounds at least three sides of an inner muntin grid element. In some of the embodiments, the outer muntin grid element surrounds the inner muntin grid element. In the context of this application, the word "surrounds" refers to the end views depicted in FIGS. 27A-27G where the cross section of the outer element surrounds the cross section of the inner element. Some of these embodiments have the advantage that a connector is not needed to hold the outer element on the inner element. No connector is needed in the embodiments where the outer element is wrapped around the inner element.

Figure 27A:
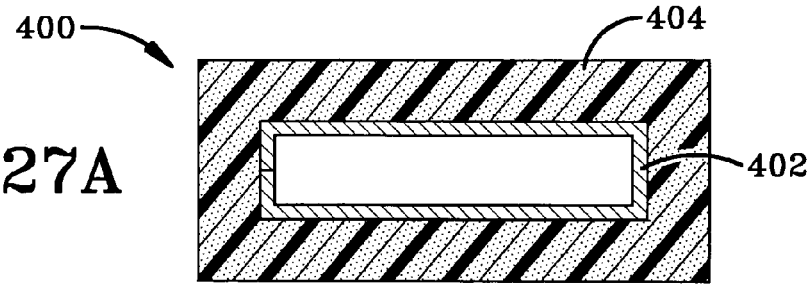
FIG. 27A is a sectional end view showing an inner muntin grid element surrounded by an outer muntin grid element wherein the outer muntin grid element is in the form of a tube.
Figure 32:
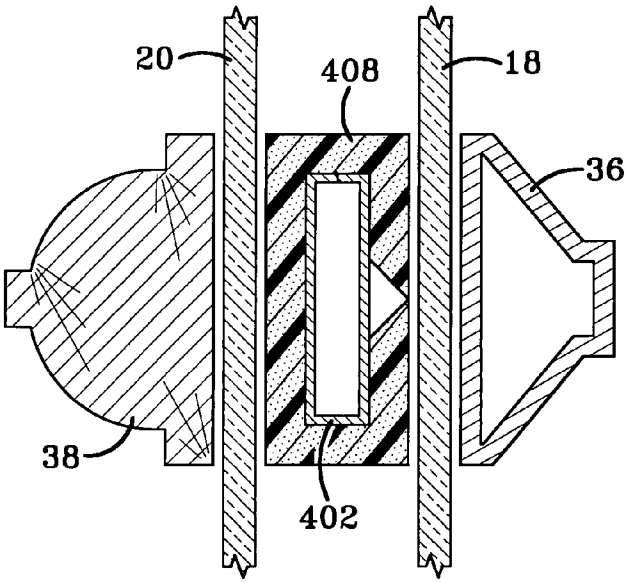
FIG. 32 is a sectional view of a portion of an insulating window unit using the muntin grid elements of the present invention.
Figure 33:
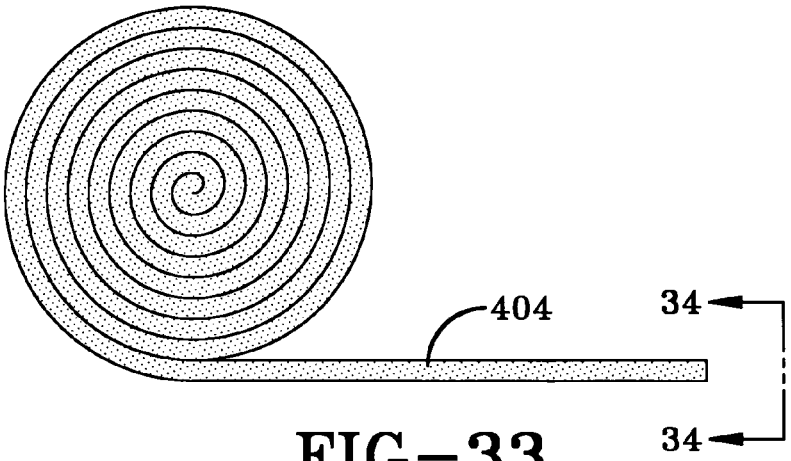
FIG. 33 is a side view of a coil of outer muntin grid element material made in accordance with an alternative embodiment of the invention.
Figure 34:
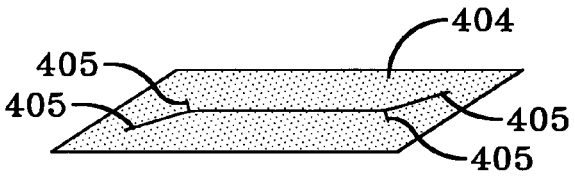
FIG. 34 is an end view of the outer muntin grid element material taken along line 34-34 of FIG. 33.
Figure 35:
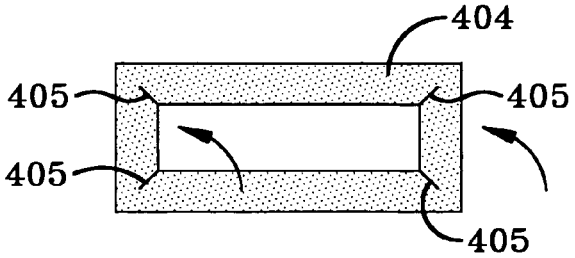
FIG. 35 is a view similar to FIG. 34 showing the outer muntin grid element material in a position where it is ready to be slid over the inner muntin element.

One embodiment is indicated generally by the numeral 400 in FIG. 27A. Muntin grid piece 400 includes an inner muntin grid element 402 and an outer muntin grid element 404 that surrounds inner muntin grid element 402. In this embodiment, outer muntin grid element 404 is in the form of a tube that slides over the outside of inner muntin grid element 402. The resulting muntin grid piece 400 may be used with other muntin grid pieces to form a muntin grid 406 (FIGS. 28 and 29) that may be positioned between glass sheets 18 and 20 in an insulating window unit as depicted in FIG. 32. Outer muntin grid element 404 may be collapsed for storage as depicted in FIGS. 33-35 and as further described below.

Figure 28:
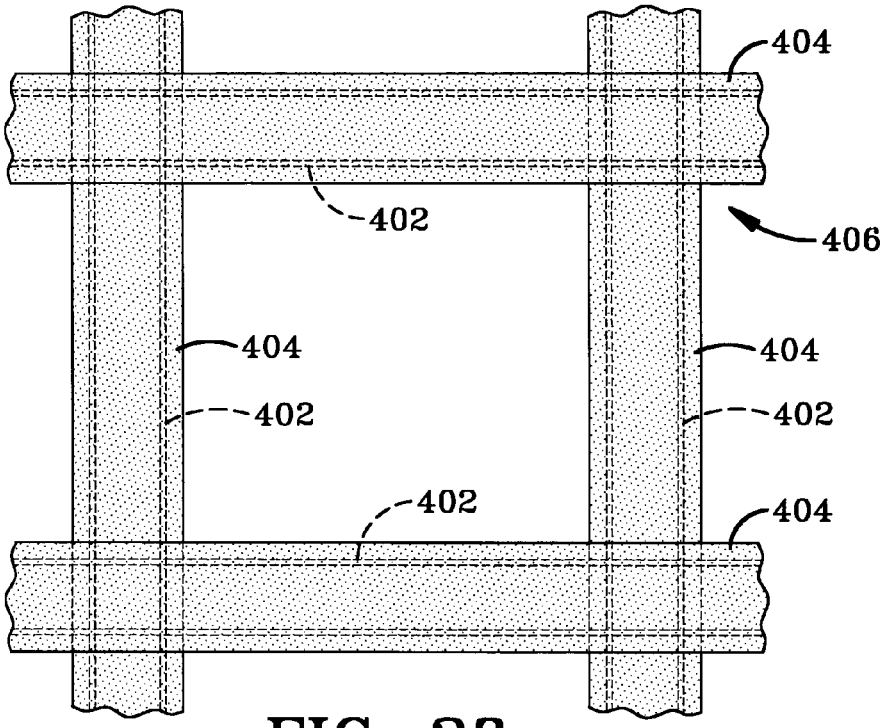
FIG. 28 is a front elevational view of four intersections in a muntin grid formed with the muntin grid pieces of the present invention.
Figure 29:
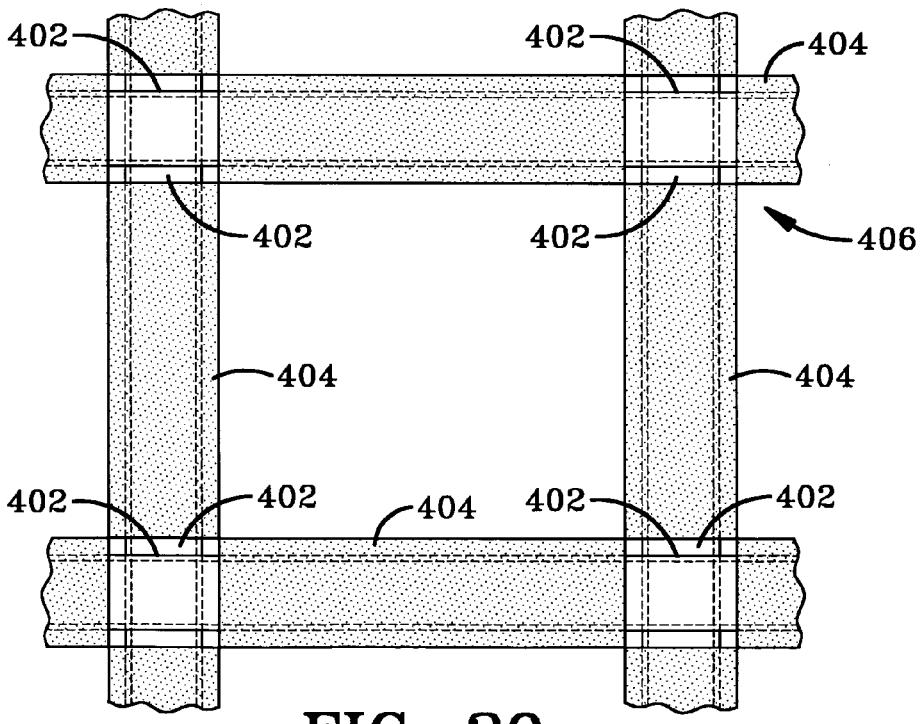
FIG. 29 is a front elevational view of four intersections of a muntin grid formed with the muntin grid pieces of the present invention.
Figures 30A, 30B:
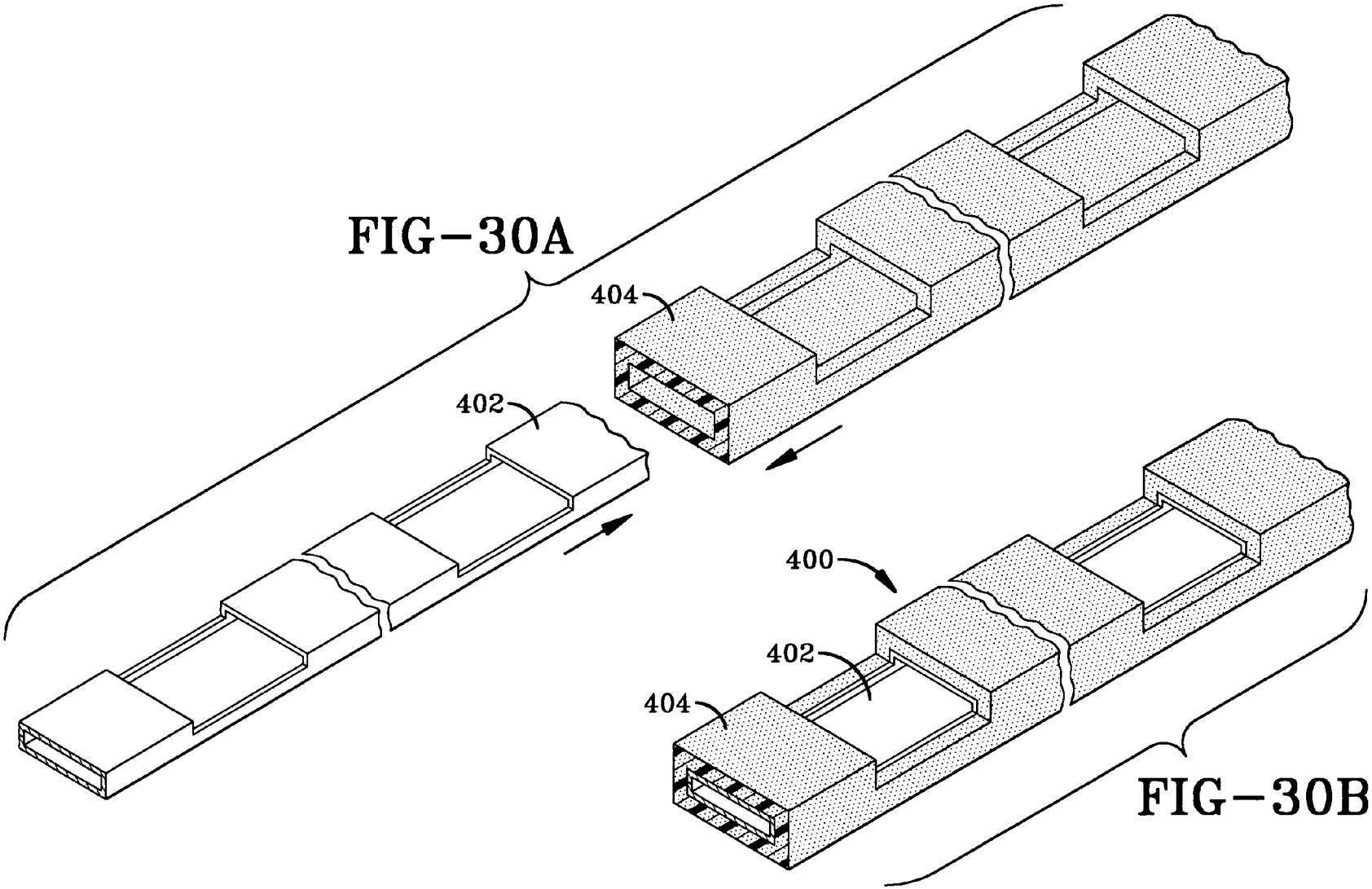
FIG. 30A is a schematic view of a first step of a process used to connect the outer muntin grid elements to the inner muntin grid elements.
FIG. 30B is a schematic view of another step wherein the outer muntin grid element is slid over the inner muntin grid element.

In the embodiment of the invention depicted in FIG. 27A, outer muntin grid element 404 substantially matches the shape of inner muntin grid element 402. In this embodiment, both elements 402 and 404 are rectangular and outer muntin grid element 404 may be sized to frictionally engage inner muntin grid element 402. Muntin grid piece 400 is assembled by sliding outer muntin grid element 404 over inner muntin grid element 402 and aligning the ends of the elements. Pieces 400 may be assembled into muntin grid 406 by notching elements 402 and 404 as depicted in FIG. 30A and attaching the notched pieces to form lap joints as depicted in FIG. 28. In another embodiment, outer muntin grid element 404 is provided in multiple individual lengths that fit over a single inner muntin grid element 402 as depicted in FIG. 29. The outer elements 404 do not overlap in FIG. 29 although outer elements 404 may be cut to lengths that allow them to slightly overlap at their ends. Pieces 400 may be fabricated and assembled by any of the methods described above.

Outer muntin grid element 404 may be fabricated from a foam material. In one embodiment of the invention, the foam material may carry a desiccant. The foam material is opaque and may be colored as desired by the window manufacturer. The metal that is typically used to form inner muntin grid element 402 does not need to be painted because it is hidden from view by outer muntin grid element 404.

Figure 27B:
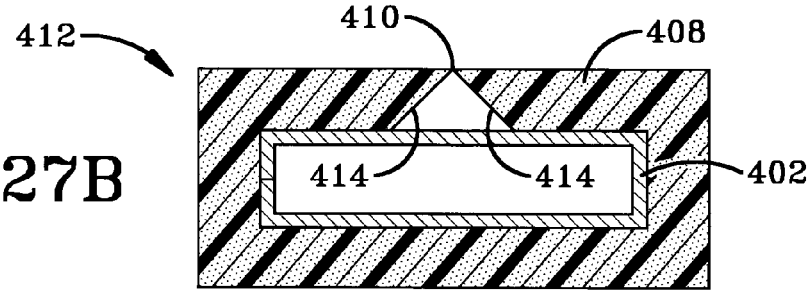
FIG. 27B is a view similar to FIG. 27A with the outer muntin grid element being longitudinally slit so that it may be wrapped around the inner muntin grid element.

In FIG. 27B, the outer muntin grid element 408 defines a longitudinal slit 410 that allows element 408 to be spread open and wrapped around element 402 to form a muntin grid piece 412. Slit 410 may be formed when element 408 is fabricated or slit 410 may be formed by cutting or tearing element 404 in a longitudinal direction. In other embodiments, element 408 may be extruded in the final shape. Slit 410 of element 404 also may be formed by passing a sharp cutting surface through one of the walls of element 404 or passing element 404 through a cutting blade.

The ends of the walls of element 408 may include angled surfaces 414 that help to close element 408 around element 402. The angled surfaces 414 may abut each other and may overlap to completely close element 408 about element 402.

Muntin grid element 408 may be fabricated from a material that has memory so that it will return to its resting position after being spread open and wrapped around element 402. The wrapping and returning steps are depicted in FIGS. 31A-31D.

Figure 27C:
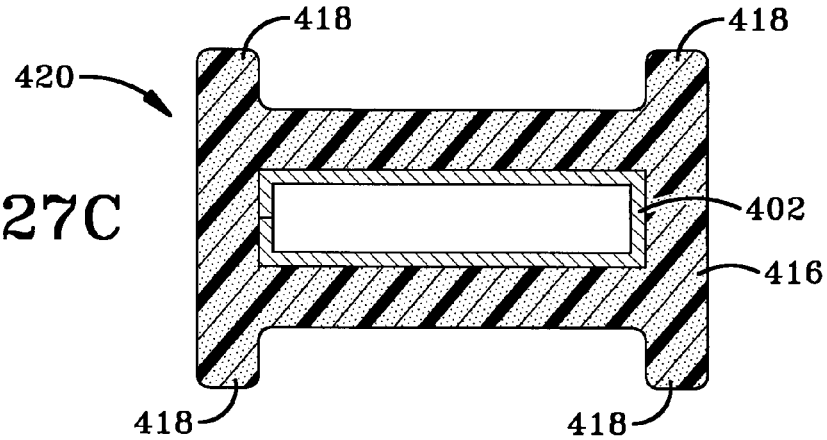
FIG. 27C is a view similar to FIG. 27A showing an alternative embodiment of the outer muntin grid element.

In FIG. 27C, the outer muntin grid element 416 includes protruding feet 418 that increase the width of element 416. Feet 418 fill more of the gap between the inner surfaces of glass sheets 18 and 20 when the muntin grid piece 420 is positioned between sheets 18 and 20.

Figure 27D:
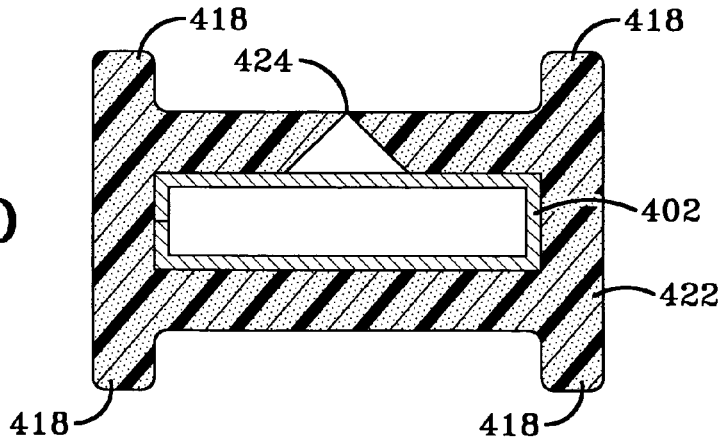
FIG. 27D is a view similar to FIG. 27B showing an alternative embodiment of the outer muntin grid element.

In FIG. 27D, outer muntin grid element 422 includes a longitudinal slit 424 that allows element 422 to be wrapped around element 402 in the same manner as described above.

In each of the embodiments described in FIGS. 27A, 27B, 27C, and 27D, the connection between the outer grid element and the inner grid element is achieved without the use of connectors such as adhesives. The connections are independent of adhesives or other connectors which prevents the outer grid elements from falling off or delaminating when the grid pieces are used in the environment of an insulating window unit that is extremely hot and extremely cold.

Figure 27E:
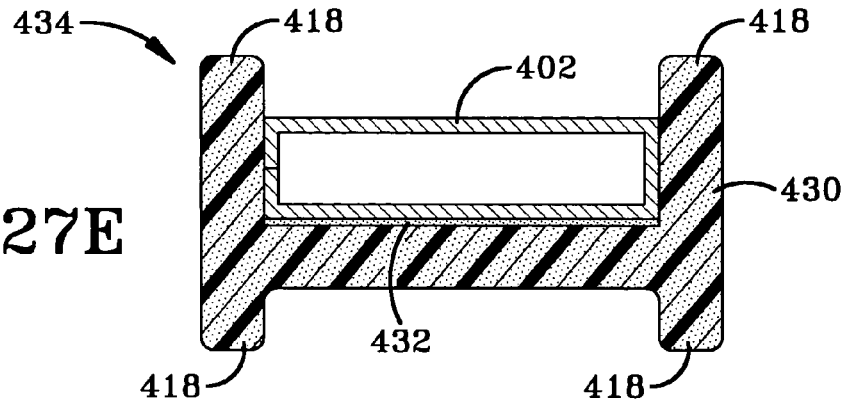
FIG. 27E is a view similar to FIG. 27C showing an alternative embodiment of the outer muntin grid element wherein the outer muntin grid element is connected to the inner muntin grid element with a connector.

In FIG. 27E, the outer grid element 430 is disposed on only three sides of inner grid element 402. A connector such as an adhesive 432 may connect at least one side of element 430 to element 402 to prevent it from falling off or delaminating. Mechanical connectors may also be used to connect element 430 to element 402. In another embodiment, element 430 may be frictionally held against inner element 402. Outer element 430 may be fabricated with biased legs that grip inner element 402 to hold the two elements together.

Figure 27F:
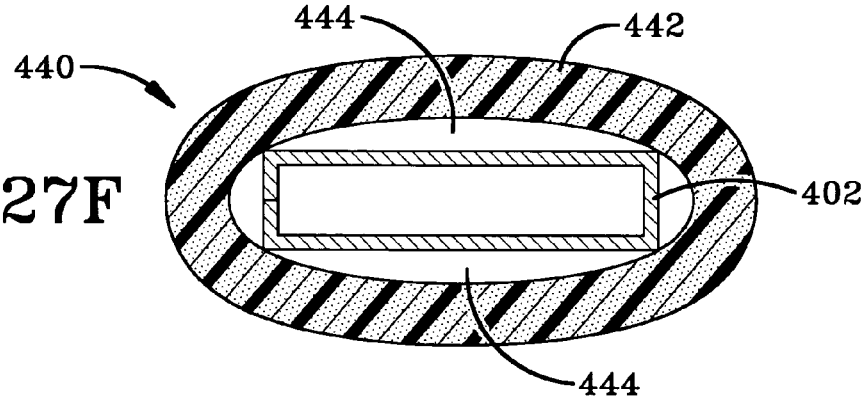
FIG. 27F is a view similar to FIG. 27A showing an alternative version of the outer muntin grid element.

In FIG. 27F, the muntin grid piece 440 includes an outer muntin grid element 442 that has a rounded cross section such that there are spaces 444 disposed between element 442 and element 402. In FIG. 27F, outer muntin grid element 442 is slid over element 402.

Figure 27G:
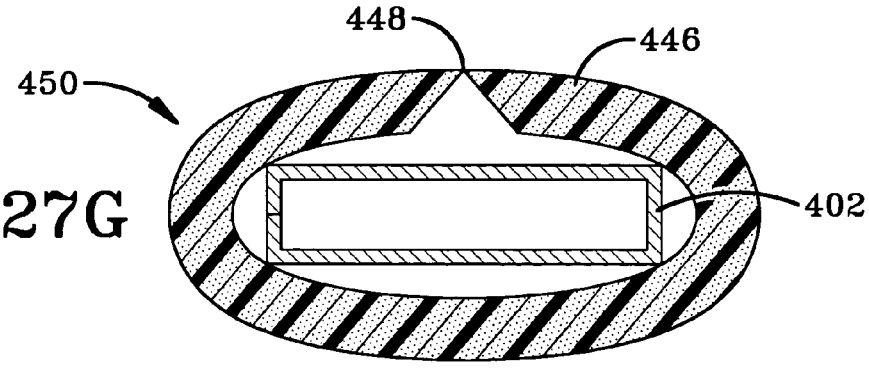
FIG. 27G is a view similar to FIG. 27B showing an alternative embodiment of the muntin grid element.

In FIG. 27G, the outer muntin grid element 446 defines a slit 448 that allows element 446 to be wrapped around element 402 to form muntin grid piece 450.

Any of the muntin grid pieces described above may be assembled into a grid by either of the two methods depicted in FIGS. 30 and 31. In FIGS. 30A and 30B, the outer muntin grid element is slid over the end of the inner muntin grid element. In FIGS. 30A and 30B, the muntin grid elements are notched to form lap joints as depicted in FIG. 28. When the jointing method depicted in FIG. 29 is used, multiple outer muntin grid elements are slipped over a single inner muntin grid element to provide the necessary piece to form the grid of FIG. 29.

Figure 31A:
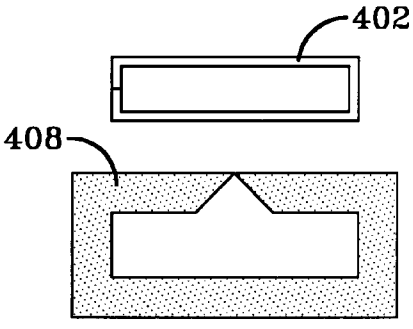
FIG. 31A is a schematic end view of a first step in another process of assembling the muntin grid pieces wherein the outer muntin grid element is wrapped around the inner muntin grid element.
Figure 31B:
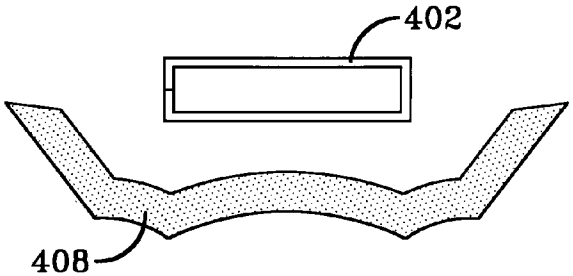
FIG. 31B is a view similar to FIG. 31A depicting another step in the process of wrapping the outer muntin grid element around the inner muntin grid element.
Figure 31C:
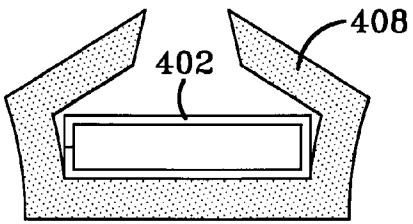
FIG. 31C depicts a further step of the process depicted in FIGS. 31A and 31B.
Figure 31D:
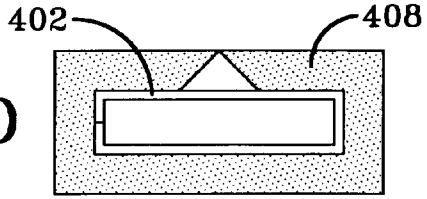
FIG. 31D depicts a final step in the process depicted in FIGS. 31A-31C.

When the outer muntin grid element is slit to allow it to be wrapped around the inner muntin grid element, the two elements may be joined with automated equipment immediately after the inner muntin grid element is fabricated. The inner muntin grid element may be roll formed with automated metal forming equipment. A supply of outer muntin element material may be provided to provide the outer muntin grid element materials to be joined with the inner muntin grid element sections downstream of the roll forming equipment. The joining steps may be performed by spreading open the outer muntin grid element sections as depicted in FIG. 31B, bringing the inner muntin grid element into contact or close spacing with the spread open outer muntin grid element, and allowing the outer muntin grid element to spring back to its closed position as depicted in FIGS. 31C and 31D. Rollers may be used to contact the outer surface of the outer muntin grid element to help it return to its resting position. The muntin grid pieces may then be cut to length or notched as needed to form the muntin grid. In other embodiments, the inner and outer muntin grid elements may be cut or notched separately before being joined together as described above with respect to the other embodiments of the invention. In other embodiments, the outer muntin grid element may be spread open by hand and placed over the inner muntin grid element.

Figure 36:
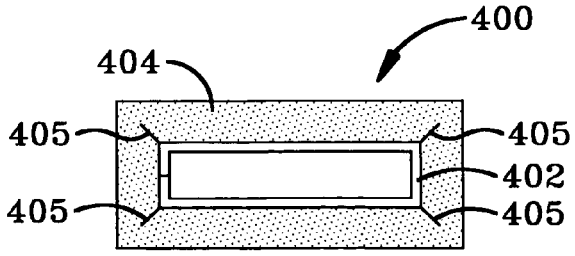
FIG. 36 is a view of the outer muntin grid element of FIG. 35 positioned over an inner muntin element.

An alternative embodiment of the outer muntin grid element is depicted in FIGS. 33-36. In this embodiment, the outer muntin grid element is fabricated so that it may be collapsed as depicted in FIG. 34. The collapsed outer muntin grid element may be rolled for storage as depicted in FIG. 33. The memory of the material may allow the outer muntin grid element to spring open as depicted in FIG. 35 so that it may be positioned to surround the inner muntin grid element as depicted in FIG. 36. In another embodiment, the element is formed in the collapsed shape. The collapsed element is opened up and positioned around the inner muntin grid element. In one example, outer muntin grid element is formed to have a parallelogram-shaped cross section to allow it to collapse and open up. The corners of the parallelogram may be slit on the inside as indicated by numeral 405 to allow the parallelogram to collapse and open up.

Figure 37:
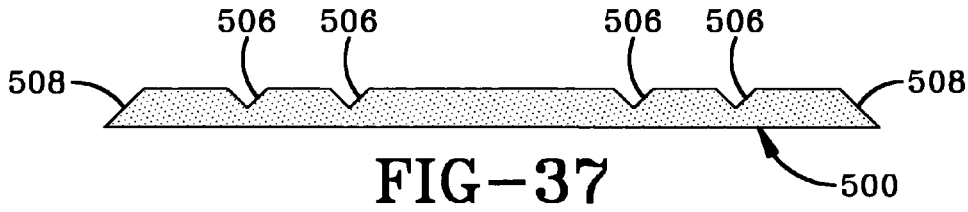
FIG. 37 is an end view of an alternative embodiment of the outer muntin grid element before it is combined with the inner muntin grid element.
Figure 40:
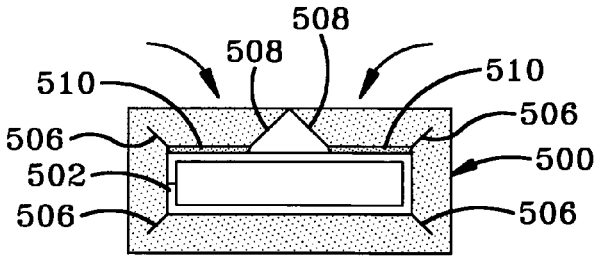
FIG. 40 is a view similar to FIG. 37 showing the outer muntin grid element being folded around the inner muntin grid element.

An alternative embodiment of the outer muntin grid element is depicted in FIG. 37 and is indicated generally by the numeral 500. Outer muntin grid element 500 is formed in a generally planar or flat configuration so that it may be easily stored in rolls such as the roll depicted in FIG. 33. Outer muntin grid element 500 is wrapped around an inner muntin grid element 502 to form a muntin grid piece 504 as depicted in FIG. 40.

Outer muntin grid element 500 includes a plurality of corner notches 506 that allow outer muntin grid element 500 to be folded around inner muntin grid element 502. Notches 506 may be formed when element 500 is formed or notches 506 may be formed after the body of element 500 is formed. The area of outer muntin grid element 500 disposed between corner notches 506 forms a wall of outer muntin grid element 500 when it is folded around inner muntin grid element 502. The ends 508 of the walls of element 500 may be angled as described above.

Figure 38:
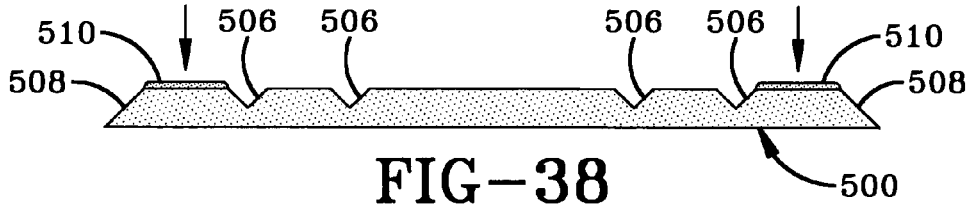
FIG. 38 is a view similar to FIG. 37 showing layers of adhesive being added to the ends of the outer muntin grid element.
Figure 39:
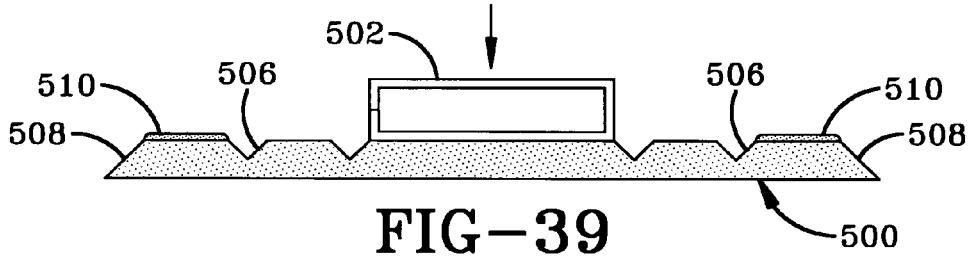
FIG. 39 is a view similar to FIG. 37 showing the inner muntin grid element being positioned relative to the outer muntin grid element.

In FIG. 38, two areas of adhesive 510 are applied to the inner ends of outer muntin grid element 500. A pressure sensitive adhesive 510 may be used. Adhesive 510 connects outer muntin grid element 500 to inner muntin grid element 502 when outer muntin grid element 500 is wrapped around inner muntin grid element 502 as depicted in FIG. 40. Adhesive 510 may be disposed on the entire inner surface of outer muntin grid element 500 if desired.

Figure 41:
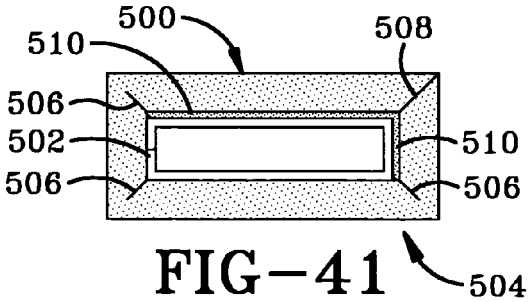
FIG. 41 is a view similar to FIG. 37 showing an alternative embodiment of the outer muntin grid element.
Figure 42:
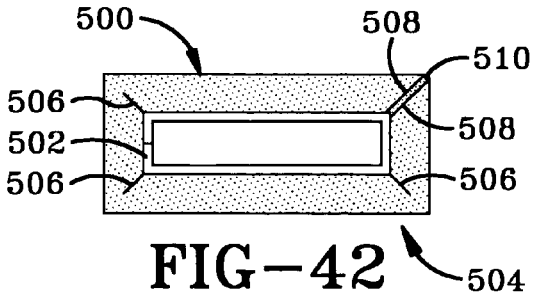
FIG. 42 is a view similar to FIG. 41 showing an alternative embodiment of the outer muntin grid element.

FIG. 41 depicts an alternative embodiment where the ends of the walls of outer muntin grid element 500 are positioned at a corner when outer muntin grid element 500 is wrapped around inner muntin grid element 502. In this embodiment, adhesive 510 is also moved to be adjacent the corner. In FIG. 42, adhesive 510 is disposed on the angled ends 508 of the walls to connect outer muntin grid element 500 back to itself around inner muntin grid element 502.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A simulated divided lite insulating glazing unit having an internal muntin bar grid; the unit comprising:

first and second spaced glass sheets spaced apart by a perimeter spacer; the first and second glass sheets and spacer defining an insulating chamber;

an internal muntin bar grid disposed inside the insulating chamber; the internal muntin bar grid extending between different portions of the perimeter spacer to divide the insulating chamber into separate lites to provide a divided-lite appearance to the glazing unit; the internal muntin bar grid having a plurality of inner muntin grid elements that each has a longitudinal direction and a plurality of flexible, collapsible outer muntin grid elements that each has a longitudinal direction; the inner muntin grid elements being arranged in a grid that defines the pattern of the internal muntin bar grid;

the outer muntin grid elements surrounding the inner muntin grid elements to completely hide the inner muntin and elements of the internal muntin bar grid from view; and when the combined inner and outer muntin grid elements are viewed in a cross section taken perpendicular to the longitudinal direction, the outer muntin grid element completely surrounding the inner muntin grid element.

2. The unit of claim 1, wherein the outer muntin grid elements are fabricated from a foam material.

3. The unit of claim 2, wherein the outer muntin grid elements have a desiccant.

4. The unit of claim 1, wherein at least one of the outer muntin grid elements includes at least one protruding foot that increases the width of the outer muntin grid element; the foot protruding in a direction perpendicular to the first and second glass sheets.

5. The unit of claim 1, wherein the outer muntin grid elements are resilient.

6. The unit of claim 1, wherein the inner muntin grid elements cross each other at lap joints and the outer muntin grid elements are notched at the lap joints.

7. A simulated divided lite insulating glazing unit having an internal muntin bar; the unit comprising:

first and second spaced glass sheets spaced apart by a perimeter spacer; the first and second glass sheets and spacer defining an insulating chamber;

an internal muntin bar disposed inside the insulating chamber; the internal muntin bar extending away from the perimeter spacer to divide the insulating chamber into separate portions to provide a divided-lite appearance to the glazing unit;

the internal muntin bar having an inner muntin grid element and a flexible, collapsible outer muntin grid element;

the outer muntin grid element substantially surrounding the inner muntin grid element to hide the inner muntin grid element from view on both sides of the insulating glazing unit;

the outer muntin grid element having a longitudinal direction; the outer muntin grid element defining a longitudinal slit that allows the outer muntin grid element to be opened and wrapped around the inner muntin grid element.

8. The unit of claim 7, wherein the outer muntin grid element defines opposed longitudinal ends that define the slit; the opposed longitudinal ends being configured to overlap each other to close the slit.

9. A simulated divided lite insulating glazing unit having an internal muntin bar; the unit comprising:

first and second spaced glass sheets spaced apart by a perimeter spacer; the first and second glass sheets and spacer defining an insulating chamber;

an internal muntin bar disposed inside the insulating chamber; the internal muntin bar extending away from the perimeter spacer to divide the insulating chamber into separate lites to provide a divided-lite appearance to the glazing unit; the internal muntin bar having:

an inner muntin grid element;

an outer muntin grid element having an inner surface and an outer surface;

the outer muntin grid element being fabricated from a foam material;

the outer muntin grid element being in the form of a tube disposed around the inner muntin grid element to hide the inner muntin grid element from view on both sides of the unit when the muntin grid piece is installed; and the tube having a sidewall and defining a slit that allows the tube to be opened and wrapped around the inner muntin grid element; the slit extending from the inner surface to the outer surface through the sidewall of the tube.

10. The unit of claim 9, wherein the outer muntin grid element has a desiccant.

11. The unit of claim 9, wherein the slit in the outer muntin grid element defines opposed ends; the opposed ends being angled away from each other.

12. The unit of claim 9, wherein the tube is collapsible and resilient.

13. In combination, an inner muntin grid element and an outer muntin grid element used to form a muntin grid piece in a simulated divided lite window having an insulating chamber; the muntin grid piece being adapted to be disposed within the insulating chamber of the simulated divided lite window; the outer muntin grid element being adapted to fold around the inner muntin grid element; the inner muntin grid element having a longitudinal direction, a plurality of spaced corners and a cross sectional perimeter dimension measured about a cross section viewed normal to the longitudinal direction of the inner muntin grid element; the combination comprising:

an outer muntin grid element having a body having a width and a longitudinal direction;

the body having spaced longitudinal ends that define the width of the body;

the width being substantially equal to the cross sectional perimeter dimension of the inner muntin grid element; and the body defining one corner notch for at least three of the corners of the inner muntin grid element, each of the corner notches extending into the body of the outer muntin grid element; the corner notches being spaced apart to align with the corners of the inner muntin grid element when the body is wrapped around the inner muntin grid element.

14. The combination of claim 13, wherein the body is flexible.

15. The combination of claim 14, wherein the body is resilient.

16. The combination of claim 15, wherein the body is fabricated from a foam.

17. The combination of claim 16, wherein the foam includes a desiccant.

18. The combination of claim 13, further comprising an adhesive connected to the body; the adhesive adapted to connect the body to the inner muntin grid element when the body is wrapped around the inner muntin grid element.

19. A simulated divided lite insulating glazing unit having an internal muntin bar; the unit comprising:

first and second spaced glass sheets spaced apart by a perimeter spacer; the first and second glass sheets and spacer defining an insulating chamber;

an internal muntin bar grid disposed inside the insulating chamber; the internal muntin bar grid dividing the insulating chamber into separate portions to provide a divided-lite appearance to the glazing unit;

the internal muntin bar grid having a plurality of inner muntin grid elements and a plurality of outer muntin grid elements; the outer muntin grid elements being fabricated from a non-metallic foam material;

the inner muntin grid elements having at least pairs of longitudinal edges and at least pairs of longitudinal sides;

the inner muntin grid elements being disposed in a grid arrangement that defines the pattern of the internal muntin bar grid;

each of the outer muntin grid elements being a unitary tube having a continuous sidewall that encloses a length of an inner muntin grid element longitudinal edges and longitudinal sides to hide the longitudinal edges and longitudinal sides of the enclosed portion of the inner muntin grid element from view on both sides of the insulating glazing unit.

20. The unit of claim 19, wherein each of the inner muntin grid elements extends between two spaced portions of the perimeter spacer.

21. The unit of claim 20, wherein the inner muntin grid elements cross each other at lap joints.

22. The unit of claim 21, wherein the outer muntin grid elements are notched at the lap joints.

* * * * *